US009859631B2

(12) United States Patent
Burris

(10) Patent No.: US 9,859,631 B2
(45) Date of Patent: Jan. 2, 2018

(54) COAXIAL CABLE CONNECTOR WITH INTEGRAL RADIO FREQUENCY INTERFERENCE AND GROUNDING SHIELD

(71) Applicant: Corning Gilbert, Inc., Glendale, AZ (US)

(72) Inventor: Donald Andrew Burris, Peoria, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

(21) Appl. No.: 15/255,625

(22) Filed: Sep. 2, 2016

(65) Prior Publication Data

US 2016/0372845 A1 Dec. 22, 2016

Related U.S. Application Data

(63) Continuation of application No. 14/750,435, filed on Jun. 25, 2015, now abandoned, which is a (Continued)

(51) Int. Cl.
*H01R 24/40* (2011.01)
*H01R 9/05* (2006.01)
(Continued)

(52) U.S. Cl.
CPC ..... *H01R 9/05* (2013.01); *H01R 9/0524* (2013.01); *H01R 13/622* (2013.01); *H01R 24/40* (2013.01); *H01R 2103/00* (2013.01)

(58) Field of Classification Search
CPC .. H01R 2103/00; H01R 24/40; H01R 9/0524; H01R 13/622; H01R 9/05; H01R 9/0521;
(Continued)

(56) References Cited

U.S. PATENT DOCUMENTS 331,169 A 11/1885 Thomas
346,958 A 8/1886 Stone
(Continued)

FOREIGN PATENT DOCUMENTS

CA 2096710 11/1994
CN 1210379 3/1993
(Continued)

OTHER PUBLICATIONS

Corning Gilbert 2004 OEM Coaxial Products Catalog, Quick Disconnects, 2 pages.

(Continued)

*Primary Examiner* — Truc Nguyen
(74) *Attorney, Agent, or Firm* — Brad C. Rametta

(57) ABSTRACT

A coaxial cable connector for coupling a coaxial cable to an equipment port is disclosed. The coaxial cable connector comprises a tubular post, a coupler and a body. The coupler has a first end rotatably secured over the second end of the tubular post, and an opposing second end. The coupler includes a central bore extending therethrough. A portion of the central bore is proximate the second end of the coupler and adapted for engaging the equipment port. The body is secured to the tubular post and extends about a first end of the tubular post for receiving an outer conductor of the coaxial cable. A portion of at least one of the tubular post, the coupler and the body provides a spring-like force on the surface of at least one of the other of the tubular post, the coupler and the body to establish an electrically conductive path therebetween.

25 Claims, 13 Drawing Sheets

Related U.S. Application Data continuation of application No. 13/605,498, filed on Sep. 6, 2012, now abandoned.

(60) Provisional application No. 61/535,062, filed on Sep. 15, 2011.

(51) Int. Cl.
*H01R 13/622* (2006.01)
*H01R 103/00* (2006.01)

(58) Field of Classification Search
CPC H01R 24/38; H01R 13/6592; H01R 13/5202; H01R 13/6581; H01R 13/6593; H01R 4/304; H01R 13/5205; H01R 13/6584
See application file for complete search history.

(56) References Cited

U.S. PATENT DOCUMENTS 459,951 A 9/1891 Warner
589,216 A 8/1897 McKee
1,371,742 A 3/1921 Dringman
1,488,175 A 3/1924 Strandell
1,667,485 A 4/1928 MacDonald
1,766,869 A 6/1930 Austin
1,801,999 A 4/1931 Bowman
1,885,761 A 11/1932 Peirce, Jr.
1,959,302 A 5/1934 Paige
2,013,526 A 9/1935 Schmitt
2,059,920 A 11/1936 Weatherhead, Jr.
2,102,495 A 12/1937 England
2,258,528 A 10/1941 Wurzburger
2,258,737 A 10/1941 Browne
2,325,549 A 7/1943 Ryzowitz
2,480,963 A 9/1949 Quinn
2,544,654 A 3/1951 Brown
2,549,647 A 4/1951 Turenne
2,694,187 A 11/1954 Nash
2,705,652 A 4/1955 Kaiser
2,743,505 A 5/1956 Hill
2,754,487 A 7/1956 Carr et al.
2,755,331 A 7/1956 Melcher
2,757,351 A 7/1956 Klostermann
2,762,025 A 9/1956 Melcher
2,785,384 A 3/1957 Wickesser
2,805,399 A 9/1957 Leeper
2,816,949 A 12/1957 Curtiss
2,870,420 A 1/1959 Malek
2,878,039 A 3/1959 Hoegee et al.
2,881,406 A 4/1959 Arson
2,963,536 A 12/1960 Kokalas
3,001,169 A 9/1961 Blonder
3,015,794 A 1/1962 Kishbaugh
3,051,925 A 8/1962 Felts
3,091,748 A 5/1963 Takes et al.
3,094,364 A 6/1963 Lingg
3,103,548 A 9/1963 Concelman
3,106,548 A 10/1963 Lavalou
3,140,106 A 7/1964 Thomas et al.
3,161,451 A 12/1964 Neidecker
3,184,706 A 5/1965 Atkins
3,193,309 A 7/1965 Morris
3,194,292 A 7/1965 Borowsky
3,196,382 A 7/1965 Morello, Jr.
3,206,540 A 9/1965 Cohen
3,245,027 A 4/1966 Ziegler, Jr.
3,275,913 A 9/1966 Blanchard et al.
3,278,890 A 10/1966 Cooney
3,281,756 A 10/1966 O'Keefe et al.
3,281,757 A 10/1966 Bonhomme
3,290,069 A 12/1966 Davis
3,292,136 A 12/1966 Somerset
3,320,575 A 5/1967 Brown et al.
3,321,732 A 5/1967 Forney, Jr.
3,336,563 A 8/1967 Hyslop
3,348,186 A 10/1967 Rosen
3,350,667 A 10/1967 Shreve
3,350,677 A 10/1967 Daum
3,355,698 A 11/1967 Keller
3,372,364 A 3/1968 O'Keefe et al.
3,373,243 A 3/1968 Janowiak et al.
3,390,374 A 6/1968 Forney, Jr.
3,406,373 A 10/1968 Forney, Jr.
3,430,184 A 2/1969 Acord
3,448,430 A 6/1969 Kelly
3,453,376 A 7/1969 Ziegler, Jr. et al.
3,465,281 A 9/1969 Florer
3,475,545 A 10/1969 Stark et al.
3,494,400 A 2/1970 McCoy et al.
3,498,647 A 3/1970 Schroder
3,499,671 A 3/1970 Osborne
3,501,737 A 3/1970 Harris et al.
3,517,373 A 6/1970 Jamon
3,526,871 A 9/1970 Hobart
3,533,051 A 10/1970 Ziegler, Jr.
3,537,065 A 10/1970 Winston
3,544,705 A 12/1970 Winston
3,551,882 A 12/1970 O'Keefe
3,564,487 A 2/1971 Upstone et al.
3,587,033 A 6/1971 Brorein et al.
3,596,933 A 8/1971 Luckenbill
3,601,776 A 8/1971 Curl
3,603,912 A 9/1971 Kelly
3,614,711 A 10/1971 Anderson et al.
3,622,952 A 11/1971 Hilbert
3,629,792 A 12/1971 Dorrell
3,633,150 A 1/1972 Schwartz
3,646,502 A 2/1972 Hutter et al.
3,663,926 A 5/1972 Brandt
3,665,371 A 5/1972 Cripps
3,668,612 A 6/1972 Nepovim
3,669,472 A 6/1972 Nadsady
3,671,922 A 6/1972 Zerlin et al.
3,671,926 A 6/1972 Nepovim
3,678,444 A 7/1972 Stevens et al.
3,678,445 A 7/1972 Brancaloene
3,680,034 A 7/1972 Chow et al.
3,681,739 A 8/1972 Kornick
3,683,320 A 8/1972 Woods et al.
3,686,623 A 8/1972 Nijman
3,694,792 A 9/1972 Wallo
3,694,793 A 9/1972 Concelman
3,697,930 A 10/1972 Shirey
3,706,958 A 12/1972 Blanchenot
3,708,186 A 1/1973 Takagi et al.
3,710,005 A 1/1973 French
3,739,076 A 6/1973 Schwartz
3,744,007 A 7/1973 Horak
3,744,011 A 7/1973 Blanchenot
3,761,870 A 9/1973 Drezin et al.
3,778,535 A 12/1973 Forney, Jr.
3,781,762 A 12/1973 Quackenbush
3,781,898 A 12/1973 Holloway
3,783,178 A 1/1974 Philibert et al.
3,787,796 A 1/1974 Barr
3,793,610 A 2/1974 Brishka
3,798,589 A 3/1974 Deardurff
3,808,580 A 4/1974 Johnson
3,810,076 A 5/1974 Hutter
3,824,026 A 7/1974 Gaskins
3,835,443 A 9/1974 Arnold et al.
3,836,700 A 9/1974 Niemeyer
3,845,453 A 10/1974 Hemmer
3,846,738 A 11/1974 Nepovim
3,847,463 A 11/1974 Hayward et al.
3,854,003 A 12/1974 Duret
3,854,789 A 12/1974 Kaplan
3,858,156 A 12/1974 Zarro
3,879,102 A 4/1975 Horak
3,886,301 A 5/1975 Cronin et al.
3,907,335 A 9/1975 Burge et al.
3,907,399 A 9/1975 Spinner
3,910,673 A 10/1975 Stokes
3,915,539 A 10/1975 Collins

(56) References Cited

U.S. PATENT DOCUMENTS 3,936,132 A 2/1976 Hutter
3,937,547 A 2/1976 Lee-Kemp
3,953,097 A 4/1976 Graham
3,960,428 A 6/1976 Naus et al.
3,963,320 A 6/1976 Spinner
3,963,321 A 6/1976 Burger et al.
3,970,355 A 7/1976 Pitschi
3,972,013 A 7/1976 Shapiro
3,976,352 A 8/1976 Spinner
3,980,805 A 9/1976 Lipari
3,985,418 A 10/1976 Spinner
3,986,736 A 10/1976 Takagi et al.
4,012,105 A 3/1977 Biddle
4,017,139 A 4/1977 Nelson
4,022,966 A 5/1977 Gajajiva
4,030,742 A 6/1977 Eidelberg et al.
4,030,798 A 6/1977 Paoli
4,032,177 A 6/1977 Anderson
4,045,706 A 8/1977 Daffner et al.
4,046,451 A 9/1977 Juds et al.
4,053,200 A 10/1977 Pugner
4,056,043 A 11/1977 Sriramamurty et al.
4,059,330 A 11/1977 Shirey
4,079,343 A 3/1978 Nijman
4,082,404 A 4/1978 Flatt
4,090,028 A 5/1978 Vontobel
4,093,335 A 6/1978 Schwartz et al.
4,100,943 A 7/1978 Terada et al.
4,106,839 A 8/1978 Cooper
4,109,126 A 8/1978 Halbeck
4,118,097 A 10/1978 Budnick
4,125,308 A 11/1978 Schilling
4,126,372 A 11/1978 Hashimoto et al.
4,131,332 A 12/1978 Hogendobler et al.
4,136,897 A 1/1979 Haluch
4,150,250 A 4/1979 Lundeberg
4,153,320 A 5/1979 Townshend
4,156,554 A 5/1979 Aujla
4,165,911 A 8/1979 Laudig
4,168,921 A 9/1979 Blanchard
4,169,646 A 10/1979 Stape et al.
4,173,385 A 11/1979 Fenn et al.
4,174,875 A 11/1979 Wilson et al.
4,187,481 A 2/1980 Bourtos
4,193,655 A 3/1980 Herrmann, Jr.
4,194,338 A 3/1980 Trafton
4,197,628 A 4/1980 Conti et al.
4,206,963 A 6/1980 English et al.
4,212,487 A 7/1980 Jones et al.
4,225,162 A 9/1980 Dola
4,227,765 A 10/1980 Neumann et al.
4,229,714 A 10/1980 Yu
4,239,318 A 12/1980 Schwartz
4,250,348 A 2/1981 Kitagawa
4,260,212 A 4/1981 Ritchie
4,273,405 A 6/1981 Law
4,280,749 A 7/1981 Hemmer
4,285,564 A 8/1981 Spinner
4,290,663 A 9/1981 Fowler et al.
4,296,986 A 10/1981 Herrmann, Jr.
4,307,926 A 12/1981 Smith
4,309,050 A 1/1982 Legris
4,310,211 A 1/1982 Bunnell et al.
4,322,121 A 3/1982 Riches et al.
4,326,768 A 4/1982 Punako
4,326,769 A 4/1982 Dorsey et al.
4,334,730 A 6/1982 Colwell et al.
4,339,166 A 7/1982 Dayton
4,345,375 A 8/1982 Hayward
4,346,958 A 8/1982 Blanchard
4,354,721 A 10/1982 Luzzi
4,358,174 A 11/1982 Dreyer
4,373,767 A 2/1983 Cairns
4,389,081 A 6/1983 Gallusser et al.
4,400,050 A 8/1983 Hayward
4,407,529 A 10/1983 Holman
4,408,821 A 10/1983 Forney, Jr.
4,408,822 A 10/1983 Nikitas
4,412,717 A 11/1983 Monroe
4,421,377 A 12/1983 Spinner
4,426,127 A 1/1984 Kubota
4,428,639 A 1/1984 Hillis
4,444,453 A 4/1984 Kirby et al.
4,447,107 A 5/1984 Major et al.
4,452,503 A 6/1984 Forney, Jr.
4,453,200 A 6/1984 Trcka et al.
4,456,323 A 6/1984 Pitcher et al.
4,459,881 A 7/1984 Hughes, Jr.
4,462,653 A 7/1984 Flederbach et al.
4,464,000 A 8/1984 Werth et al.
4,464,001 A 8/1984 Collins
4,469,386 A 9/1984 Ackerman
4,470,657 A 9/1984 Deacon
4,477,132 A 10/1984 Moser et al.
4,484,792 A 11/1984 Tengler et al.
4,484,796 A 11/1984 Sato et al.
4,490,576 A 12/1984 Bolante et al.
4,491,685 A 1/1985 Drew et al.
4,506,943 A 3/1985 Drogo
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,633 A 10/1985 McGeary
4,545,637 A 10/1985 Bosshard et al.
4,553,877 A 11/1985 Edvardsen
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,623,205 A 11/1986 Barron
4,632,487 A 12/1986 Wargula
4,634,213 A 1/1987 Larsson et al.
4,640,572 A 2/1987 Conlon
4,645,281 A 2/1987 Burger
4,647,135 A 3/1987 Reinhardt
4,650,228 A 3/1987 McMills et al.
4,655,159 A 4/1987 McMills
4,655,534 A 4/1987 Stursa
4,660,921 A 4/1987 Hauver
4,666,190 A 5/1987 Yamabe et al.
4,666,231 A 5/1987 Sheesley et al.
4,668,043 A 5/1987 Saba et al.
4,670,574 A 6/1987 Malcolm
4,673,236 A 6/1987 Musolff et al.
4,674,809 A 6/1987 Hollyday et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gullusser et al.
4,703,988 A 11/1987 Raux et al.
4,713,021 A 12/1987 Kobler
4,717,355 A 1/1988 Mattis
4,720,155 A 1/1988 Schildkraut et al.

(56) References Cited

U.S. PATENT DOCUMENTS 4,728,301 A 3/1988 Hemmer et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,739,009 A 4/1988 Down et al.
4,739,126 A 4/1988 Gutter et al.
4,746,305 A 5/1988 Nomura
4,747,656 A 5/1988 Miyahara et al.
4,747,786 A 5/1988 Hayashi et al.
4,749,821 A 6/1988 Linton et al.
4,755,152 A 7/1988 Elliot et al.
4,757,274 A 7/1988 Bowers
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,789,759 A 12/1988 Jones
4,795,360 A 1/1989 Newman et al.
4,797,120 A 1/1989 Ulery
4,806,116 A 2/1989 Ackerman
4,807,891 A 2/1989 Neher
4,808,128 A 2/1989 Werth
4,810,017 A 3/1989 Knak et al.
4,813,886 A 3/1989 Roos et al.
4,820,185 A 4/1989 Moulin
4,834,675 A 5/1989 Samchisen
4,834,676 A 5/1989 Tackett
4,835,342 A 5/1989 Guginsky
4,836,580 A 6/1989 Farrell
4,836,801 A 6/1989 Ramirez
4,838,813 A 6/1989 Pauza et al.
4,846,731 A 7/1989 Alwine
4,854,893 A 8/1989 Morris
4,857,014 A 8/1989 Alf et al.
4,867,489 A 9/1989 Patel
4,867,706 A 9/1989 Tang
4,869,679 A 9/1989 Szegda
4,874,331 A 10/1989 Iverson
4,881,912 A 11/1989 Thommen et al.
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,963,105 A 10/1990 Lewis et al.
4,964,805 A 10/1990 Gabany
4,964,812 A 10/1990 Siemon et al.
4,973,265 A 11/1990 Heeren
4,976,632 A 12/1990 Riches
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,018,822 A 5/1991 Freismuth et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,139 A 10/1991 Spinner
5,059,747 A 10/1991 Bawa et al.
5,062,804 A 11/1991 Jamet et al.
5,066,248 A 11/1991 Gaver, Jr. et al.
5,067,912 A 11/1991 Bickford et al.
5,073,129 A 12/1991 Szegda
5,074,809 A 12/1991 Rousseau et al.
5,080,600 A 1/1992 Baker et al.
5,083,943 A 1/1992 Tarrant
5,088,937 A 2/1992 Gabany
5,120,260 A 6/1992 Jackson
5,123,864 A 6/1992 Karlovich
5,127,853 A 7/1992 McMills et al.
5,131,862 A 7/1992 Gershfeld
5,137,470 A 8/1992 Doles
5,137,471 A 8/1992 Verespej et al.
5,139,440 A 8/1992 Volk et al.
5,141,448 A 8/1992 Mattingly et al.
5,141,451 A 8/1992 Down
5,149,274 A 9/1992 Gallusser et al.
5,150,924 A 9/1992 Yokomatsu et al.
5,154,636 A 10/1992 Vaccaro et al.
5,161,993 A 11/1992 Leibfried, Jr.
5,166,477 A 11/1992 Perin, Jr. et al.
5,167,545 A 12/1992 O'Brien et al.
5,169,323 A 12/1992 Kawai et al.
5,176,530 A 1/1993 Reylek
5,176,533 A 1/1993 Sakurai et al.
5,181,161 A 1/1993 Hirose et al.
5,183,417 A 2/1993 Bools
5,185,655 A 2/1993 Glenday et al.
5,186,501 A 2/1993 Mano
5,186,655 A 2/1993 Glenday et al.
5,195,904 A 3/1993 Cyvoct
5,195,905 A 3/1993 Pesci
5,195,906 A 3/1993 Szegda
5,205,547 A 4/1993 Mattingly
5,205,761 A 4/1993 Nilsson
D335,487 S 5/1993 Volk et al.
5,207,602 A 5/1993 McMills et al.
5,215,477 A 6/1993 Weber et al.
5,217,391 A 6/1993 Fisher, Jr.
5,217,392 A 6/1993 Hosler, Sr.
5,217,393 A 6/1993 Del Negro et al.
5,221,216 A 6/1993 Gabany et al.
5,227,587 A 7/1993 Paterek
5,247,424 A 9/1993 Harris et al.
5,263,880 A 11/1993 Schwarz et al.
5,269,701 A 12/1993 Leibfried, Jr.
5,281,762 A 1/1994 Long et al.
5,283,417 A 2/1994 Misawa et al.
5,283,853 A 2/1994 Szegda
5,284,449 A 2/1994 Vaccaro
5,294,864 A 3/1994 Do
5,295,864 A 3/1994 Birch et al.
5,316,348 A 5/1994 Franklin
5,316,494 A 5/1994 Flanagan et al.
5,318,459 A 6/1994 Sheilds
5,321,205 A 6/1994 Bawa et al.
5,334,032 A 8/1994 Myers et al.
5,334,051 A 8/1994 Devine et al.
5,338,225 A 8/1994 Jacobsen et al.
5,342,218 A 8/1994 McMills et al.
5,352,134 A 10/1994 Jacobsen et al.
5,354,217 A 10/1994 Gabel et al.
5,362,250 A 11/1994 McMills et al.
5,362,251 A 11/1994 Bielak
5,366,260 A 11/1994 Wartluft
5,371,819 A 12/1994 Szegda
5,371,821 A 12/1994 Szegda
5,371,827 A 12/1994 Szegda
5,380,211 A 1/1995 Kawagauchi et al.
5,389,005 A 2/1995 Kodama
5,393,244 A 2/1995 Szegda
5,397,252 A 3/1995 Wang
5,413,504 A 5/1995 Kloecker et al.

(56) References Cited

U.S. PATENT DOCUMENTS

| | | | |
|---|---|---|---|
| 5,431,583 | A | 7/1995 | Szegda |
| 5,435,745 | A | 7/1995 | Booth |
| 5,435,751 | A | 7/1995 | Papenheim et al. |
| 5,435,760 | A | 7/1995 | Miklos |
| 5,439,386 | A | 8/1995 | Ellis et al. |
| 5,444,810 | A | 8/1995 | Szegda |
| 5,455,548 | A | 10/1995 | Grandchamp et al. |
| 5,456,611 | A | 10/1995 | Henry et al. |
| 5,456,614 | A | 10/1995 | Szegda |
| 5,466,173 | A | 11/1995 | Down |
| 5,470,257 | A | 11/1995 | Szegda |
| 5,474,478 | A | 12/1995 | Ballog |
| 5,475,921 | A | 12/1995 | Johnston |
| 5,488,268 | A | 1/1996 | Bauer et al. |
| 5,490,033 | A | 2/1996 | Cronin |
| 5,490,801 | A | 2/1996 | Fisher, Jr. et al. |
| 5,494,454 | A | 2/1996 | Johnsen |
| 5,499,934 | A | 3/1996 | Jacobsen et al. |
| 5,501,616 | A | 3/1996 | Holliday |
| 5,511,305 | A | 4/1996 | Garner |
| 5,516,303 | A | 5/1996 | Yohn et al. |
| 5,525,076 | A | 6/1996 | Down |
| 5,542,861 | A | 8/1996 | Anhalt et al. |
| 5,548,088 | A | 8/1996 | Gray et al. |
| 5,550,521 | A | 8/1996 | Bernaud et al. |
| 5,564,938 | A | 10/1996 | Shenkal et al. |
| 5,566,173 | A | 10/1996 | Steinbrecher |
| 5,571,028 | A | 11/1996 | Szegda |
| 5,571,029 | A | 11/1996 | Poissant et al. |
| 5,586,910 | A | 12/1996 | Del Negro et al. |
| 5,595,499 | A | 1/1997 | Zander et al. |
| 5,598,132 | A | 1/1997 | Stabile |
| 5,607,320 | A | 3/1997 | Wright |
| 5,607,325 | A | 3/1997 | Toma |
| 5,609,501 | A | 3/1997 | McMills et al. |
| 5,620,339 | A | 4/1997 | Gray et al. |
| 5,632,637 | A | 5/1997 | Diener |
| 5,632,651 | A | 5/1997 | Szegda |
| 5,644,104 | A | 7/1997 | Porter et al. |
| 5,649,723 | A | 7/1997 | Larsson |
| 5,651,698 | A | 7/1997 | Locati et al. |
| 5,651,699 | A | 7/1997 | Holliday |
| 5,653,605 | A | 8/1997 | Woehl et al. |
| 5,667,405 | A | 9/1997 | Holliday |
| 5,681,172 | A | 10/1997 | Moldenhauer |
| 5,683,263 | A | 11/1997 | Hsu |
| 5,702,263 | A | 12/1997 | Baumann et al. |
| 5,722,856 | A | 3/1998 | Fuchs et al. |
| 5,735,704 | A | 4/1998 | Anthony |
| 5,743,131 | A | 4/1998 | Holliday et al. |
| 5,746,617 | A | 5/1998 | Porter, Jr. et al. |
| 5,746,619 | A | 5/1998 | Harting et al. |
| 5,759,618 | A | 6/1998 | Taylor |
| 5,761,053 | A | 6/1998 | King et al. |
| 5,769,652 | A | 6/1998 | Wider |
| 5,769,662 | A | 6/1998 | Stabile et al. |
| 5,774,344 | A | 6/1998 | Casebolt |
| 5,775,927 | A | 7/1998 | Wider |
| 5,788,289 | A | 8/1998 | Cronley |
| 5,791,698 | A | 8/1998 | Wartluft et al. |
| 5,797,633 | A | 8/1998 | Katzer et al. |
| 5,817,978 | A | 10/1998 | Hermant et al. |
| 5,863,220 | A | 1/1999 | Holliday |
| 5,874,603 | A | 2/1999 | Arkles |
| 5,877,452 | A | 3/1999 | McConnell |
| 5,879,191 | A | 3/1999 | Burris |
| 5,882,226 | A | 3/1999 | Bell et al. |
| 5,890,924 | A | 4/1999 | Endo |
| 5,897,795 | A | 4/1999 | Lu et al. |
| 5,906,511 | A | 5/1999 | Bozzer et al. |
| 5,917,153 | A | 6/1999 | Geroldinger |
| 5,921,793 | A | 7/1999 | Phillips |
| 5,929,383 | A | 7/1999 | Marik et al. |
| 5,938,465 | A | 8/1999 | Fox, Sr. |
| 5,944,548 | A | 8/1999 | Saito |
| 5,951,327 | A | 9/1999 | Marik |
| 5,954,708 | A | 9/1999 | Lopez et al. |
| 5,957,716 | A | 9/1999 | Buckley et al. |
| 5,967,852 | A | 10/1999 | Follingstad et al. |
| 5,975,479 | A | 11/1999 | Suter |
| 5,975,591 | A | 11/1999 | Guest |
| 5,975,949 | A | 11/1999 | Holliday et al. |
| 5,975,951 | A | 11/1999 | Burris et al. |
| 5,977,841 | A | 11/1999 | Lee et al. |
| 5,997,350 | A | 12/1999 | Burris et al. |
| 6,010,349 | A | 1/2000 | Porter, Jr. |
| 6,019,635 | A | 2/2000 | Nelson |
| 6,022,237 | A | 2/2000 | Esh |
| 6,032,358 | A | 3/2000 | Wild |
| 6,036,540 | A | 3/2000 | Beloritsky |
| 6,042,422 | A | 3/2000 | Youtsey |
| 6,042,429 | A | 3/2000 | Bianca et al. |
| 6,048,229 | A | 4/2000 | Lazaro, Jr. |
| 6,053,743 | A | 4/2000 | Mitchell et al. |
| 6,053,769 | A | 4/2000 | Kubota et al. |
| 6,053,777 | A | 4/2000 | Boyle |
| 6,062,607 | A | 5/2000 | Barthlomew |
| 6,080,015 | A | 6/2000 | Andreescu |
| 6,083,030 | A | 7/2000 | Wright |
| 6,083,053 | A | 7/2000 | Anderson, Jr. et al. |
| 6,089,903 | A | 7/2000 | Stafford Gray et al. |
| 6,089,912 | A | 7/2000 | Tallis et al. |
| 6,089,913 | A | 7/2000 | Holliday |
| 6,093,043 | A | 7/2000 | Gray et al. |
| 6,095,828 | A | 8/2000 | Burland |
| 6,095,841 | A | 8/2000 | Felps |
| 6,123,550 | A | 9/2000 | Burkert et al. |
| 6,123,567 | A | 9/2000 | McCarthy |
| 6,126,487 | A | 10/2000 | Rosenberger et al. |
| 6,132,234 | A | 10/2000 | Waidner et al. |
| 6,142,812 | A | 11/2000 | Hwang |
| 6,146,197 | A | 11/2000 | Holliday et al. |
| 6,152,752 | A | 11/2000 | Fukuda |
| 6,152,753 | A | 11/2000 | Johnson et al. |
| 6,153,830 | A | 11/2000 | Montena |
| 6,158,298 | A | 12/2000 | Hara |
| 6,162,995 | A | 12/2000 | Bachle et al. |
| 6,164,977 | A | 12/2000 | Lester |
| 6,174,206 | B1 | 1/2001 | Yentile et al. |
| 6,183,298 | B1 | 2/2001 | Henningsen |
| 6,199,913 | B1 | 3/2001 | Wang |
| 6,199,920 | B1 | 3/2001 | Neustadtl |
| 6,210,216 | B1 | 4/2001 | Tso-Chin et al. |
| 6,210,219 | B1 | 4/2001 | Zhu et al. |
| 6,210,222 | B1 | 4/2001 | Langham et al. |
| 6,217,383 | B1 | 4/2001 | Holland et al. |
| 6,238,240 | B1 | 5/2001 | Yu |
| 6,239,359 | B1 | 5/2001 | Lilienthal, II et al. |
| 6,241,553 | B1 | 6/2001 | Hsia |
| 6,250,942 | B1 | 6/2001 | Lemke et al. |
| 6,250,974 | B1 | 6/2001 | Kerek |
| 6,257,923 | B1 | 7/2001 | Stone et al. |
| 6,261,126 | B1 | 7/2001 | Stirling |
| 6,267,612 | B1 | 7/2001 | Areykiewicz et al. |
| 6,271,464 | B1 | 8/2001 | Cunningham |
| 6,299,475 | B1 | 10/2001 | Huspeni et al. |
| 6,331,123 | B1 | 12/2001 | Rodrigues |
| 6,332,815 | B1 | 12/2001 | Bruce |
| 6,352,448 | B1 | 3/2002 | Holliday et al. |
| 6,358,077 | B1 | 3/2002 | Young |
| 6,361,348 | B1 | 3/2002 | Hall et al. |
| 6,361,364 | B1 | 3/2002 | Holland et al. |
| 6,375,509 | B2 | 4/2002 | Mountford |
| 6,379,183 | B1 | 4/2002 | Ayres et al. |
| 6,394,840 | B1 | 5/2002 | Gassauer et al. |
| 6,396,367 | B1 | 5/2002 | Rosenberger |
| D458,904 | S | 6/2002 | Montena |
| 6,398,571 | B1 | 6/2002 | Nishide et al. |
| 6,406,330 | B2 | 6/2002 | Bruce |
| 6,409,534 | B1 | 6/2002 | Weisz-Margulescu |
| D460,739 | S | 7/2002 | Fox |
| D460,740 | S | 7/2002 | Montena |
| D460,946 | S | 7/2002 | Montena |
| D460,947 | S | 7/2002 | Montena |

(56) References Cited

U.S. PATENT DOCUMENTS

| | | | |
|---|---|---|---|
| D460,948 | S | 7/2002 | Montena |
| 6,422,884 | B1 | 7/2002 | Babasick et al. |
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| 6,439,899 | B1 | 8/2002 | Muzslay et al. |
| D462,327 | S | 9/2002 | Montena |
| 6,443,763 | B1 | 9/2002 | Richet |
| 6,450,829 | B1 | 9/2002 | Weisz-Margulescu |
| 6,454,463 | B1 | 9/2002 | Halbach |
| 6,464,526 | B1 | 10/2002 | Seufert et al. |
| 6,464,527 | B2 | 10/2002 | Volpe et al. |
| 6,467,816 | B1 | 10/2002 | Huang |
| 6,468,100 | B1 | 10/2002 | Meyer et al. |
| 6,468,103 | B1 | 10/2002 | Brower |
| 6,491,546 | B1 | 12/2002 | Perry |
| D468,696 | S | 1/2003 | Montena |
| 6,506,083 | B1 | 1/2003 | Bickford et al. |
| 6,510,610 | B2 | 1/2003 | Losinger |
| 6,520,800 | B1 | 2/2003 | Michelbach et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,632,104 | B2 | 10/2003 | Quadir |
| 6,634,906 | B1 | 10/2003 | Yeh |
| 6,637,101 | B2 | 10/2003 | Hathaway et al. |
| 6,645,011 | B2 | 11/2003 | Schneider et al. |
| 6,663,397 | B1 | 12/2003 | Lin et al. |
| 6,676,446 | B2 | 1/2004 | Montena |
| 6,683,253 | B1 | 1/2004 | Lee |
| 6,683,773 | B2 | 1/2004 | Montena |
| 6,690,081 | B2 | 2/2004 | Bakir et al. |
| 6,692,285 | B2 | 2/2004 | Islam |
| 6,692,286 | B1 | 2/2004 | De Cet |
| 6,695,636 | B2 | 2/2004 | Hall et al. |
| 6,705,875 | B2 | 3/2004 | Berghorn et al. |
| 6,705,884 | B1 | 3/2004 | McCarthy |
| 6,709,280 | B1 | 3/2004 | Gretz |
| 6,709,289 | B2 | 3/2004 | Huber et al. |
| 6,712,631 | B1 | 3/2004 | Youtsey |
| 6,716,041 | B2 | 4/2004 | Ferderer et al. |
| 6,716,062 | B1 | 4/2004 | Palinkas et al. |
| 6,733,336 | B1 | 5/2004 | Montena et al. |
| 6,733,337 | B2 | 5/2004 | Kodaira |
| 6,743,040 | B1 | 6/2004 | Nakamura |
| 6,749,454 | B2 | 6/2004 | Schmidt et al. |
| 6,751,081 | B1 | 6/2004 | Kooiman |
| 6,752,633 | B2 | 6/2004 | Aizawa et al. |
| 6,761,571 | B2 | 7/2004 | Hida |
| 6,767,248 | B1 | 7/2004 | Hung |
| 6,769,926 | B1 | 8/2004 | Montena |
| 6,780,029 | B1 | 8/2004 | Gretz |
| 6,780,042 | B1 | 8/2004 | Badescu et al. |
| 6,780,052 | B2 | 8/2004 | Montena et al. |
| 6,780,068 | B2 | 8/2004 | Bartholoma et al. |
| 6,783,394 | B1 | 8/2004 | Holliday |
| 6,786,767 | B1 | 9/2004 | Fuks et al. |
| 6,790,081 | B2 | 9/2004 | Burris et al. |
| 6,793,528 | B2 | 9/2004 | Lin et al. |
| 6,796,847 | B2 | 9/2004 | AbuGhazaleh |
| 6,802,738 | B1 | 10/2004 | Henningsen |
| 6,805,581 | B2 | 10/2004 | Chen |
| 6,805,583 | B2 | 10/2004 | Holliday et al. |
| 6,805,584 | B1 | 10/2004 | Chen |
| 6,808,415 | B1 | 10/2004 | Montena |
| 6,817,272 | B2 | 11/2004 | Holland |
| 6,817,896 | B2 | 11/2004 | Derenthal |
| 6,817,897 | B2 | 11/2004 | Chee |
| 6,827,608 | B2 | 12/2004 | Hall et al. |
| 6,830,479 | B2 | 12/2004 | Holliday |
| 6,848,115 | B2 | 1/2005 | Sugiura et al. |
| 6,848,939 | B2 | 2/2005 | Stirling |
| 6,848,940 | B2 | 2/2005 | Montena |
| 6,848,941 | B2 | 2/2005 | Wlos et al. |
| 6,884,113 | B1 | 4/2005 | Montena |
| 6,884,115 | B2 | 4/2005 | Malloy |
| 6,887,102 | B1 | 5/2005 | Burris et al. |
| 6,916,200 | B2 | 7/2005 | Burris et al. |
| 6,929,265 | B2 | 8/2005 | Holland et al. |
| 6,929,508 | B1 | 8/2005 | Holland |
| 6,935,866 | B2 | 8/2005 | Kerekes et al. |
| 6,939,169 | B2 | 9/2005 | Islam et al. |
| 6,942,516 | B2 | 9/2005 | Shimoyama et al. |
| 6,942,520 | B2 | 9/2005 | Barlian et al. |
| 6,944,005 | B2 | 9/2005 | Kooiman |
| 6,945,805 | B1 | 9/2005 | Bollinger |
| 6,948,976 | B2 | 9/2005 | Goodwin et al. |
| 6,953,371 | B2 | 10/2005 | Baker et al. |
| 6,955,563 | B1 | 10/2005 | Croan |
| D511,497 | S | 11/2005 | Murphy et al. |
| D512,024 | S | 11/2005 | Murphy et al. |
| D512,689 | S | 12/2005 | Murphy et al. |
| 6,971,912 | B2 | 12/2005 | Montena et al. |
| 6,979,234 | B2 | 12/2005 | Bleicher |
| 7,008,263 | B2 | 3/2006 | Holland |
| 7,018,216 | B1 | 3/2006 | Clark et al. |
| 7,018,235 | B1 | 3/2006 | Burris et al. |
| 7,029,326 | B2 | 4/2006 | Montena |
| D521,454 | S | 5/2006 | Murphy et al. |
| 7,062,851 | B2 | 6/2006 | Koessler |
| 7,063,565 | B2 | 6/2006 | Ward |
| 7,070,447 | B1 | 7/2006 | Montena |
| 7,077,697 | B2 | 7/2006 | Kooiman |
| 7,077,699 | B2 | 7/2006 | Islam et al. |
| 7,086,897 | B2 | 8/2006 | Montena |
| 7,090,525 | B1 | 8/2006 | Morana |
| 7,094,114 | B2 | 8/2006 | Kurimoto |
| 7,097,499 | B1 | 8/2006 | Purdy |
| 7,102,868 | B2 | 9/2006 | Montena |
| 7,108,547 | B2 | 9/2006 | Kisling et al. |
| 7,108,548 | B2 | 9/2006 | Burris et al. |
| 7,112,078 | B2 | 9/2006 | Czikora |
| 7,112,093 | B1 | 9/2006 | Holland |
| 7,114,990 | B2 | 10/2006 | Bence et al. |
| 7,118,285 | B2 | 10/2006 | Fenwick et al. |
| 7,118,382 | B2 | 10/2006 | Kerekes et al. |
| 7,118,416 | B2 | 10/2006 | Montena et al. |
| 7,125,283 | B1 | 10/2006 | Lin |
| 7,128,603 | B2 | 10/2006 | Burris et al. |
| 7,128,604 | B2 | 10/2006 | Hall |
| 7,131,867 | B1 | 11/2006 | Foster et al. |
| 7,131,868 | B2 | 11/2006 | Montena |
| 7,140,645 | B2 | 11/2006 | Cronley |
| 7,144,271 | B1 | 12/2006 | Burris et al. |
| 7,144,272 | B1 | 12/2006 | Burris et al. |
| 7,147,509 | B1 | 12/2006 | Burris et al. |
| 7,153,159 | B2 | 12/2006 | Burris et al. |
| 7,156,696 | B1 | 1/2007 | Montena |
| 7,161,785 | B2 | 1/2007 | Chawgo |
| 7,165,974 | B2 | 1/2007 | Kooiman |
| 7,168,992 | B2 | 1/2007 | Vo et al. |
| 7,173,121 | B2 | 2/2007 | Fang |
| 7,179,121 | B1 | 2/2007 | Burris et al. |
| 7,179,122 | B2 | 2/2007 | Holliday |
| 7,182,639 | B2 | 2/2007 | Burris |
| 7,183,639 | B2 | 2/2007 | Mihara et al. |
| 7,189,097 | B2 | 3/2007 | Benham |
| 7,189,114 | B1 | 3/2007 | Burris et al. |
| 7,192,308 | B2 | 3/2007 | Rodrigues et al. |
| 7,229,303 | B2 | 6/2007 | Vermoesen et al. |
| 7,229,550 | B2 | 6/2007 | Haase |
| 7,238,047 | B2 | 7/2007 | Saetele et al. |
| 7,252,536 | B2 | 8/2007 | Lazaro, Jr. et al. |
| 7,252,546 | B1 | 8/2007 | Holland |
| 7,255,598 | B2 | 8/2007 | Montena et al. |
| 7,261,594 | B2 | 8/2007 | Kodama et al. |
| 7,264,502 | B2 | 9/2007 | Holland |

(56) References Cited

U.S. PATENT DOCUMENTS

| | | | |
|---|---|---|---|
| 7,278,882 | B1 | 10/2007 | Li |
| 7,288,002 | B2 | 10/2007 | Rodrigues et al. |
| 7,291,033 | B2 | 11/2007 | Hu |
| 7,297,023 | B2 | 11/2007 | Chawgo |
| 7,299,550 | B2 | 11/2007 | Montena |
| 7,303,435 | B2 | 12/2007 | Burris et al. |
| 7,311,555 | B1 | 12/2007 | Burris et al. |
| 7,318,609 | B2 | 1/2008 | Naito et al. |
| 7,322,846 | B2 | 1/2008 | Camelio |
| 7,322,851 | B2 | 1/2008 | Brookmire |
| 7,329,139 | B2 | 2/2008 | Benham |
| 7,331,820 | B2 | 2/2008 | Burris et al. |
| 7,335,058 | B1 | 2/2008 | Burris et al. |
| 7,347,129 | B1 | 3/2008 | Youtsey |
| 7,347,726 | B2 | 3/2008 | Wlos |
| 7,347,727 | B2 | 3/2008 | Wlos et al. |
| 7,347,729 | B2 | 3/2008 | Thomas et al. |
| 7,351,088 | B1 | 4/2008 | Qu |
| 7,357,641 | B2 | 4/2008 | Kerekes et al. |
| 7,364,462 | B2 | 4/2008 | Holland |
| 7,371,112 | B2 | 5/2008 | Burris et al. |
| 7,371,113 | B2 | 5/2008 | Burris et al. |
| 7,375,533 | B2 | 5/2008 | Gale |
| 7,387,524 | B2 | 6/2008 | Cheng |
| 7,393,245 | B2 | 7/2008 | Palinkas et al. |
| 7,396,249 | B2 | 7/2008 | Kauffman |
| 7,404,737 | B1 | 7/2008 | Youtsey |
| 7,410,389 | B2 | 8/2008 | Holliday |
| 7,416,415 | B2 | 8/2008 | Hart et al. |
| 7,438,327 | B2 | 10/2008 | Auray et al. |
| 7,452,239 | B2 | 11/2008 | Montena |
| 7,455,550 | B1 | 11/2008 | Sykes |
| 7,458,850 | B1 | 12/2008 | Burris et al. |
| 7,458,851 | B2 | 12/2008 | Montena |
| 7,462,068 | B2 | 12/2008 | Amidon |
| 7,467,980 | B2 | 12/2008 | Chiu |
| 7,476,127 | B1 | 1/2009 | Wei |
| 7,478,475 | B2 | 1/2009 | Hall |
| 7,479,033 | B1 | 1/2009 | Sykes et al. |
| 7,479,035 | B2 | 1/2009 | Bence et al. |
| 7,484,988 | B2 | 2/2009 | Ma et al. |
| 7,484,997 | B2 | 2/2009 | Hofling |
| 7,488,210 | B1 | 2/2009 | Burris et al. |
| 7,494,355 | B2 | 2/2009 | Hughes et al. |
| 7,497,729 | B1 | 3/2009 | Wei |
| 7,500,868 | B2 | 3/2009 | Holland et al. |
| 7,500,873 | B1 | 3/2009 | Hart |
| 7,507,116 | B2 | 3/2009 | Laerke et al. |
| 7,507,117 | B2 | 3/2009 | Amidon |
| 7,513,788 | B2 | 4/2009 | Camelio |
| 7,513,795 | B1 | 4/2009 | Shaw |
| 7,537,482 | B2 | 5/2009 | Burris et al. |
| 7,540,759 | B2 | 6/2009 | Liu et al. |
| 7,544,094 | B1 | 6/2009 | Paglia et al. |
| 7,563,133 | B2 | 7/2009 | Stein |
| 7,566,236 | B2 | 7/2009 | Malloy et al. |
| 7,568,945 | B2 | 8/2009 | Chee et al. |
| 7,578,693 | B2 | 8/2009 | Yoshida et al. |
| 7,588,454 | B2 | 9/2009 | Nakata et al. |
| 7,588,460 | B2 | 9/2009 | Malloy et al. |
| 7,607,942 | B1 | 10/2009 | Van Swearingen |
| 7,625,227 | B1 | 12/2009 | Henderson et al. |
| 7,632,143 | B1 | 12/2009 | Islam |
| 7,635,283 | B1 | 12/2009 | Islam |
| 7,648,383 | B2 | 1/2010 | Burris et al. |
| 7,651,376 | B2 | 1/2010 | Schreier |
| 7,674,132 | B1 | 3/2010 | Chen |
| 7,682,177 | B2 | 3/2010 | Berthet |
| 7,682,188 | B1 | 3/2010 | Lu |
| 7,694,420 | B2 | 4/2010 | Ehret et al. |
| 7,714,229 | B2 | 5/2010 | Burris et al. |
| 7,726,996 | B2 | 6/2010 | Burris et al. |
| 7,727,011 | B2 | 6/2010 | Montena et al. |
| 7,749,021 | B2 | 7/2010 | Brodeur |
| 7,749,022 | B2 | 7/2010 | Amidon et al. |
| 7,753,705 | B2 | 7/2010 | Montena |
| 7,753,710 | B2 | 7/2010 | George |
| 7,753,727 | B1 | 7/2010 | Islam et al. |
| 7,758,356 | B2 | 7/2010 | Burris et al. |
| 7,758,370 | B1 | 7/2010 | Flaherty |
| 7,794,275 | B2 | 9/2010 | Rodrigues |
| 7,806,714 | B2 | 10/2010 | Williams et al. |
| 7,806,725 | B1 | 10/2010 | Chen |
| 7,811,133 | B2 | 10/2010 | Gray |
| 7,814,654 | B2 | 10/2010 | Pichler |
| D626,920 | S | 11/2010 | Purdy et al. |
| 7,824,216 | B2 | 11/2010 | Purdy |
| 7,828,594 | B2 | 11/2010 | Burris et al. |
| 7,828,595 | B2 | 11/2010 | Mathews |
| 7,830,154 | B2 | 11/2010 | Gale |
| 7,833,053 | B2 | 11/2010 | Mathews |
| 7,845,976 | B2 | 12/2010 | Mathews |
| 7,845,978 | B1 | 12/2010 | Chen |
| 7,845,980 | B1 | 12/2010 | Amidon |
| 7,850,472 | B2 | 12/2010 | Friedrich et al. |
| 7,850,487 | B1 | 12/2010 | Wei |
| 7,857,661 | B1 | 12/2010 | Islam |
| 7,874,870 | B1 | 1/2011 | Chen |
| 7,887,354 | B2 | 2/2011 | Holliday |
| 7,892,004 | B2 | 2/2011 | Hertzler et al. |
| 7,892,005 | B2 | 2/2011 | Haube |
| 7,892,024 | B1 | 2/2011 | Chen |
| 7,914,326 | B2 | 3/2011 | Sutter |
| 7,918,687 | B2 | 4/2011 | Paynter et al. |
| 7,927,135 | B1 | 4/2011 | Wlos |
| 7,934,954 | B1 | 5/2011 | Chawgo et al. |
| 7,934,955 | B1 | 5/2011 | Hsia |
| 7,938,662 | B2 | 5/2011 | Burris et al. |
| 7,942,695 | B1 | 5/2011 | Lu |
| 7,950,958 | B2 | 5/2011 | Mathews |
| 7,950,961 | B2 | 5/2011 | Chabalowski et al. |
| 7,955,126 | B2 | 6/2011 | Bence et al. |
| 7,972,158 | B2 | 7/2011 | Wild et al. |
| 7,972,176 | B2 | 7/2011 | Burris et al. |
| 7,982,005 | B2 | 7/2011 | Ames et al. |
| 8,011,955 | B1 | 9/2011 | Lu |
| 8,025,518 | B2 | 9/2011 | Burris et al. |
| 8,029,315 | B2 | 10/2011 | Purdy et al. |
| 8,029,316 | B2 | 10/2011 | Snyder et al. |
| 8,037,599 | B2 | 10/2011 | Pichler |
| 8,047,872 | B2 | 11/2011 | Burris et al. |
| 8,062,044 | B2 | 11/2011 | Montena et al. |
| 8,062,063 | B2 | 11/2011 | Malloy et al. |
| 8,070,504 | B2 | 12/2011 | Amidon et al. |
| 8,075,337 | B2 | 12/2011 | Malloy et al. |
| 8,075,338 | B1 | 12/2011 | Montena |
| 8,079,860 | B1 | 12/2011 | Zraik |
| 8,087,954 | B2 | 1/2012 | Fuchs |
| 8,113,875 | B2 | 2/2012 | Malloy et al. |
| 8,113,879 | B1 | 2/2012 | Zraik |
| 8,157,587 | B2 | 4/2012 | Paynter et al. |
| 8,157,588 | B1 | 4/2012 | Rodrigues et al. |
| 8,167,635 | B1 | 5/2012 | Mathews |
| 8,167,636 | B1 | 5/2012 | Montena |
| 8,172,612 | B2 | 5/2012 | Bence et al. |
| 8,177,572 | B2 | 5/2012 | Feye-Hohmann |
| 8,192,237 | B2 | 6/2012 | Purdy et al. |
| 8,206,172 | B2 | 6/2012 | Katagiri et al. |
| D662,893 | S | 7/2012 | Haberek et al. |
| 8,231,412 | B2 | 7/2012 | Paglia et al. |
| 8,262,408 | B1 | 9/2012 | Kelly |
| 8,272,893 | B2 | 9/2012 | Burris et al. |
| 8,287,310 | B2 | 10/2012 | Burris et al. |
| 8,287,320 | B2 | 10/2012 | Purdy et al. |
| 8,313,345 | B2 | 11/2012 | Purdy |
| 8,313,353 | B2 | 11/2012 | Purdy et al. |
| 8,317,539 | B2 | 11/2012 | Stein |
| 8,319,136 | B2 | 11/2012 | Byron et al. |
| 8,323,053 | B2 | 12/2012 | Montena |
| 8,323,058 | B2 | 12/2012 | Flaherty et al. |
| 8,323,060 | B2 | 12/2012 | Purdy et al. |
| 8,337,229 | B2 | 12/2012 | Montena |
| 8,366,481 | B2 | 2/2013 | Ehret et al. |
| 8,366,482 | B2 | 2/2013 | Burris et al. |

(56) References Cited

U.S. PATENT DOCUMENTS 8,376,769 B2 2/2013 Holland et al.
D678,844 S 3/2013 Haberek
8,398,421 B2 3/2013 Haberek et al.
8,430,688 B2 4/2013 Montena et al.
8,449,326 B2 5/2013 Holland et al.
8,465,322 B2 6/2013 Purdy
8,469,739 B2 6/2013 Rodrigues et al.
8,469,740 B2 6/2013 Ehret et al.
D686,164 S 7/2013 Haberek et al.
D686,576 S 7/2013 Haberek et al.
8,475,205 B2 7/2013 Ehret et al.
8,480,430 B2 7/2013 Ehret et al.
8,480,431 B2 7/2013 Ehret et al.
8,485,845 B2 7/2013 Ehret et al.
8,506,325 B2 8/2013 Malloy et al.
8,517,763 B2 8/2013 Burris et al.
8,517,764 B2 8/2013 Wei et al.
8,529,279 B2 9/2013 Montena
8,550,835 B2 10/2013 Montena
8,556,656 B2 10/2013 Thomas et al.
8,568,163 B2 10/2013 Burris et al.
8,568,165 B2 10/2013 Wei et al.
8,591,244 B2 11/2013 Thomas et al.
8,597,050 B2 12/2013 Flaherty et al.
8,622,776 B2 1/2014 Morikawa
8,636,529 B2 1/2014 Stein
8,636,541 B2 1/2014 Chastain et al.
8,647,136 B2 2/2014 Purdy et al.
7,114,990 C1 4/2014 Bence et al.
8,690,603 B2 4/2014 Bence et al.
8,721,365 B2 5/2014 Holland
8,727,800 B2 5/2014 Holland et al.
8,758,050 B2 6/2014 Montena
8,777,658 B2 7/2014 Holland et al.
8,777,661 B2 7/2014 Holland et al.
8,834,200 B2 9/2014 Shaw
8,858,251 B2 10/2014 Montena
8,888,526 B2 11/2014 Burris
8,920,192 B2 12/2014 Montena
6,558,194 C1 1/2015 Montena
6,848,940 C1 1/2015 Montena
9,017,101 B2 4/2015 Ehret et al.
8,172,612 C1 5/2015 Bence et al.
9,048,599 B2 6/2015 Burris
9,153,911 B2 10/2015 Burris et al.
9,166,307 B2 10/2015 Shaw
9,166,348 B2 10/2015 Burris et al.
9,172,154 B2 10/2015 Burris
9,172,157 B2 10/2015 Burris
9,306,324 B2 4/2016 Wei
9,343,855 B2 5/2016 Wei
2001/0034143 A1 10/2001 Annequin
2001/0046802 A1 11/2001 Perry et al.
2001/0051448 A1 12/2001 Gonzalez
2002/0013088 A1 1/2002 Rodrigues et al.
2002/0019161 A1 2/2002 Finke et al.
2002/0038720 A1 4/2002 Kai et al.
2002/0064014 A1 5/2002 Montena
2002/0146935 A1 10/2002 Wong
2003/0110977 A1 6/2003 Batlaw
2003/0119358 A1 6/2003 Henningsen
2003/0139081 A1 7/2003 Hall et al.
2003/0194890 A1 10/2003 Ferderer et al.
2003/0214370 A1 11/2003 Allison et al.
2003/0224657 A1 12/2003 Malloy
2004/0031144 A1 2/2004 Holland
2004/0077215 A1 4/2004 Palinkas et al.
2004/0102089 A1 5/2004 Chee
2004/0137778 A1 7/2004 Mattheeuws et al.
2004/0157499 A1 8/2004 Nania et al.
2004/0194585 A1 10/2004 Clark
2004/0209516 A1 10/2004 Burris et al.
2004/0219833 A1 11/2004 Burris et al.
2004/0229504 A1 11/2004 Liu
2005/0042919 A1 2/2005 Montena
2005/0079762 A1 4/2005 Hsia
2005/0159045 A1 7/2005 Huang
2005/0164553 A1* 7/2005 Montena ..... H01R 9/0518 439/578
2005/0170692 A1 8/2005 Montena
2005/0181652 A1 8/2005 Montena et al.
2005/0181668 A1 8/2005 Montena et al.
2005/0208827 A1 9/2005 Burris et al.
2005/0233636 A1 10/2005 Rodrigues et al.
2005/0255735 A1 11/2005 Ward
2006/0003629 A1* 1/2006 Murphy ..... H01R 9/05 439/578
2006/0014425 A1 1/2006 Montena
2006/0099853 A1 5/2006 Sattele et al.
2006/0110977 A1 5/2006 Matthews
2006/0113107 A1 6/2006 Williams
2006/0128217 A1 6/2006 Burris
2006/0154519 A1 7/2006 Montena
2006/0166552 A1 7/2006 Bence et al.
2006/0178046 A1 8/2006 Tusini
2006/0194465 A1 8/2006 Czikora
2006/0199040 A1 9/2006 Yamada
2006/0223355 A1 10/2006 Hirschmann
2006/0246774 A1 11/2006 Buck
2006/0258209 A1 11/2006 Hall
2006/0276079 A1 12/2006 Chen
2007/0004276 A1 1/2007 Stein
2007/0026734 A1 2/2007 Bence et al.
2007/0049113 A1 3/2007 Rodrigues et al.
2007/0054535 A1 3/2007 Hall et al.
2007/0059968 A1 3/2007 Ohtaka et al.
2007/0082533 A1 4/2007 Currier et al.
2007/0087613 A1 4/2007 Schumacher et al.
2007/0093128 A1 4/2007 Thomas et al.
2007/0123101 A1 5/2007 Palinkas
2007/0155232 A1 7/2007 Burris et al.
2007/0155233 A1 7/2007 Laerke et al.
2007/0173100 A1 7/2007 Benham
2007/0175027 A1 8/2007 Khemakhem et al.
2007/0232117 A1 10/2007 Singer
2007/0243759 A1 10/2007 Rodrigues et al.
2007/0243762 A1 10/2007 Burke et al.
2007/0287328 A1 12/2007 Hart et al.
2008/0032556 A1 2/2008 Schreier
2008/0102696 A1 5/2008 Montena
2008/0171466 A1 7/2008 Buck et al.
2008/0200066 A1 8/2008 Hofling
2008/0200068 A1 8/2008 Aguirre
2008/0214040 A1 9/2008 Holterhoff et al.
2008/0274644 A1 11/2008 Rodrigues
2008/0289470 A1 11/2008 Aston
2008/0293298 A1* 11/2008 Burris ..... H01R 13/025 439/582
2008/0310026 A1 12/2008 Nakayama
2009/0029590 A1 1/2009 Sykes et al.
2009/0098770 A1 4/2009 Bence et al.
2009/0104801 A1 4/2009 Silva
2009/0163075 A1 6/2009 Blew et al.
2009/0181560 A1 7/2009 Cherian
2009/0186505 A1 7/2009 Mathews
2009/0264003 A1 10/2009 Hertzler et al.
2009/0305560 A1 12/2009 Chen
2010/0007441 A1 1/2010 Yagisawa et al.
2010/0022125 A1 1/2010 Burris et al.
2010/0028563 A1 2/2010 Ota
2010/0029149 A1 2/2010 Malloy et al.
2010/0055978 A1 3/2010 Montena
2010/0080563 A1 4/2010 DiFonzo et al.
2010/0081321 A1 4/2010 Malloy et al.
2010/0081322 A1 4/2010 Malloy et al.
2010/0087071 A1 4/2010 DiFonzo et al.
2010/0105246 A1 4/2010 Burris et al.
2010/0124839 A1 5/2010 Montena
2010/0130060 A1 5/2010 Islam
2010/0178799 A1 7/2010 Lee
2010/0216339 A1 8/2010 Burris et al.
2010/0233901 A1 9/2010 Wild et al.
2010/0233902 A1 9/2010 Youtsey
2010/0233903 A1 9/2010 Islam

(56) References Cited

U.S. PATENT DOCUMENTS

2010/0255719 A1 10/2010 Purdy
2010/0255720 A1 10/2010 Radzik et al.
2010/0255721 A1 10/2010 Purdy et al.
2010/0273351 A1 10/2010 Holliday
2010/0279548 A1 11/2010 Montena et al.
2010/0297871 A1 11/2010 Haube
2010/0297875 A1 11/2010 Purdy et al.
2010/0304579 A1 12/2010 Kisling
2010/0323541 A1 12/2010 Amidon et al.
2011/0021072 A1 1/2011 Purdy
2011/0021075 A1 1/2011 Orner et al.
2011/0027039 A1 2/2011 Blair
2011/0039448 A1 2/2011 Stein
2011/0053413 A1 3/2011 Mathews
2011/0074388 A1 3/2011 Bowman
2011/0080158 A1 4/2011 Lawrence et al.
2011/0111623 A1 5/2011 Burris et al.
2011/0111626 A1 5/2011 Paglia et al.
2011/0117774 A1 5/2011 Malloy et al.
2011/0143567 A1 6/2011 Purdy et al.
2011/0151714 A1 6/2011 Flaherty et al.
2011/0230089 A1 9/2011 Amidon et al.
2011/0230091 A1 9/2011 Krenceski et al.
2011/0237123 A1 9/2011 Burris et al.
2011/0237124 A1 9/2011 Flaherty et al.
2011/0250789 A1 10/2011 Burris et al.
2011/0318958 A1 12/2011 Burris et al.
2012/0021642 A1 1/2012 Zraik
2012/0040537 A1 2/2012 Burris
2012/0045933 A1 2/2012 Youtsey
2012/0064768 A1 3/2012 Islam et al.
2012/0094530 A1 4/2012 Montena
2012/0100751 A1 4/2012 Montena
2012/0108098 A1 5/2012 Burris et al.
2012/0122329 A1* 5/2012 Montena ..... H01R 9/05 439/271
2012/0129387 A1 5/2012 Holland et al.
2012/0159740 A1 6/2012 Strelow et al.
2012/0171894 A1 7/2012 Malloy et al.
2012/0178289 A1 7/2012 Holliday
2012/0196476 A1* 8/2012 Haberek ..... H01R 9/05 439/578
2012/0202378 A1 8/2012 Krenceski et al.
2012/0222302 A1 9/2012 Purdy et al.
2012/0225581 A1 9/2012 Amidon et al.
2012/0315788 A1 12/2012 Montena
2012/0329311 A1 12/2012 Duval et al.
2013/0059468 A1 3/2013 Wood
2013/0065433 A1 3/2013 Burris
2013/0072044 A1* 3/2013 Jackson ..... H01R 43/005 439/272
2013/0072057 A1 3/2013 Burris
2013/0178096 A1 7/2013 Matzen
2013/0273761 A1 10/2013 Ehret et al.
2014/0051275 A1* 2/2014 Thomas ..... H01R 13/52 439/271
2014/0106612 A1 4/2014 Burris
2014/0106614 A1 4/2014 Burris et al.
2014/0120766 A1 5/2014 Meister et al.
2014/0137393 A1 5/2014 Chastain et al.
2014/0148044 A1 5/2014 Balcer et al.
2014/0148051 A1 5/2014 Bence et al.
2014/0154907 A1 6/2014 Ehret et al.
2014/0106613 A1 7/2014 Burris
2014/0235099 A1* 8/2014 Burris ..... H01R 13/6581 439/578
2014/0298650 A1 10/2014 Chastain et al.
2014/0322968 A1* 10/2014 Burris ..... H01R 9/05 439/578
2014/0342605 A1 11/2014 Burris et al.
2015/0118901 A1 4/2015 Burris
2015/0295331 A1 10/2015 Burris
2016/0118727 A1 4/2016 Burris et al.
2016/0118748 A1 4/2016 Burris et al.
2017/0025801 A1 1/2017 Edmonds

FOREIGN PATENT DOCUMENTS

CN 1292940 4/2001
CN 201149936 11/2008
CN 201149937 11/2008
CN 201178228 1/2009
CN 201904508 7/2011
DE 47931 10/1888
DE 1022889 7/1897
DE 1117687 11/1961
DE 2261973 6/1974
DE 3117320 4/1982
DE 3211008 10/1983
DE 9001608.4 4/1990
DE 4439852 5/1996
DE 19749130 8/1999
DE 19957518 9/2001
DE 10346914 5/2004
DE 102004031271 1/2006
DE 102010064071 12/2010
EP 115179 8/1984
EP 116157 8/1984
EP 167738 1/1986
EP 72104 2/1986
EP 223464 5/1987
EP 265276 4/1988
EP 350835 1/1990
EP 428424 5/1991
EP 867978 9/1998
EP 1069654 9/1998
EP 1094565 4/2001
EP 1115179 7/2001
EP 1191268 3/2002
EP 1455420 9/2004
EP 1501159 1/2005
EP 1548898 6/2005
EP 1603200 12/2005
EP 1701410 9/2006
EP 2051340 4/2009
FR 2204331 5/1974
FR 2232846 1/1975
FR 2462798 2/1981
FR 2494508 5/1982
GB 589697 6/1947
GB 1010372 11/1963
GB 1087228 10/1967
GB 1270846 4/1972
GB 1332888 10/1973
GB 1401373 7/1975
GB 1421215 1/1976
GB 2019665 10/1979
GB 2079549 1/1982
GB 2252677 8/1992
GB 2264201 8/1993
GB 2331634 5/1999
GB 2448595 10/2008
GB 2450248 12/2008
JP 3280369 12/1991
JP 2000-40564 2/2000
JP 2002-015823 1/2002
JP 200215823 1/2002
JP 4129978 8/2008
JP 4219778 2/2009
JP 2009277571 11/2009
JP 4391268 12/2009
JP 4503793 7/2010
KR 100622526 9/2006
TW 427044 3/2001
TW 200810279 2/2008
TW 200843262 11/2008
TW 201140953 11/2011
WO 8700351 1/1987
WO 9908343 2/1999
WO 00/05785 2/2000
WO 186756 11/2001

(56) References Cited

FOREIGN PATENT DOCUMENTS

| | | |
|---|---|---|
| WO | 2069457 | 9/2002 |
| WO | 2004013883 | 2/2004 |
| WO | 2004098795 | 11/2004 |
| WO | 2006081141 | 8/2006 |
| WO | 2007062845 | 6/2007 |
| WO | 2009066705 | 5/2009 |
| WO | 2010135181 | 11/2010 |
| WO | 2011057033 | 5/2011 |
| WO | 2012162431 | 5/2011 |
| WO | 2011128665 | 10/2011 |
| WO | 2011128666 | 10/2011 |
| WO | 2013126629 | 8/2013 |

OTHER PUBLICATIONS

Digicon AVL Connector. ARRIS Group Inc. [online] 3 pages. Retrieved from the Internet: <URL: http://www.arrisi.com/special/digiconAVL.asp.
US Office Action, U.S. Appl. No. 10/997,218; dated Jul. 31, 2006, pp. 1-10.
Society of Cable Telecommunications Engineers, Engineering Committee, Interface Practices Subcommittee; American National Standard; ANSI/SCTE Jan. 2006; Specification for "F" Port, Female, Outdoor. Published Jan. 2006. 9 pages.
The American Society of Mechanical Engineers; "Lock Washers (Inch Series), An American National Standard"; ASME 818.21.1-1999 (Revision of ASME B18.21.1-1994); Reaffirmed 2005. Published Feb. 11, 2000. 28 pages.
Notice of Allowance (dated Mar. 20, 2012) for U.S. Appl. No. 13/117,843.
Search Report dated Jun. 6, 2014 pertaining to International application No. PCT/US2014/023374.
Search Report dated Apr. 9, 2014 pertaining to International application No. PCT/US2014/015934.
Society of Cable Telecommunications Engineers, Engineering Committee, Interface Practices Subcommittee; American National Standard; ANSI/SCTE Feb. 2006; "Specification for "F" Port, Female, Indoor". Published Feb. 2006. 9 pages.
PPC, "Next Generation Compression Connectors," pp. 1-6, Retrieved from http://www.tessco.com/yts/partnermanufacturer list/vendors/ppc/pdf/ppc digitalspread.pdf.
Patent Cooperation Treaty, International Search Report for PCT/US2013/070497, dated Feb. 11, 2014, 3 pgs.
Patent Cooperation Treaty, International Search Report for PCT/US2013/064515, 10 pgs.
Patent Cooperation Treaty, International Search Report for PCT/US2013/064512, dated Jan. 21, 2014, 11 pgs.
Huber+Suhner AG, RF Connector Guide: Understanding connector technology, 2007, Retrieved from http://www.ie.itcr.ac.cr/marin/lic/e14515/Huber+Suener_RF_Connector_Guide.pdf.
Slade, Paul G,. Electrical Contacts: Principles and Applications, 1999, Retrieved from http://books.google.com/books (table of contents only).
Office Action dated Jun. 12, 2014 pertaining to U.S. Appl. No. 13/795,737.
Office Action dated Aug. 25, 2014 pertaining to U.S. Appl. No. 13/605,481.
Election/Restrictions Requirement dated Jul. 31, 2014 pertaining to U.S. Appl. No. 13/652,969.
Office Action dated Aug. 29, 2014 pertaining to U.S. Appl. No. 13/827,522.
Election/Restrictions Requirement dated Jun. 20, 2014 pertaining to U.S. Appl. No. 13/795,780.
Office Action dated Sep. 19, 2014 pertaining to U.S. Appl. No. 13/795,780.
Office Action dated Oct. 6, 2014 pertaining to U.S. Appl. No. 13/732,679.
Corning Cabelcon waterproof CX3 7.0 QuickMount for RG6 cables; Cabelcon Connectors; www.cabelcom.dk; Mar. 15, 2012.
Maury Jr., M.; Microwave Coaxial Connector Technology: A Continuaing Evolution; Maury Microwave Corporation; Dec. 13, 2005; pp. 1-21; Maury Microwave Inc.
"Snap-On/Push-On" SMA Adapter; RF TEC Mfg., Inc.; Mar. 23, 2006; 2 pgs.
RG6 quick mount data sheet; Corning Cabelcon; 2010; 1 pg.; Corning Cabelcon ApS.
RG11 quick mount data sheet; Corning Cabelcon; 2013; 1 pg.; Corning Cabelcon ApS.
Gilbert Engineering Co., Inc.; OEM Coaxial Connectors catalog; Aug. 1993; pg. 26.
UltraEase Compression Connectors; "F" Series 59 and 6 Connectors Product Information; May 2005; 4 pgs.
Pomona Electronics Full Line Catelog; vol. 50; 2003; pp. 1-100.
Office Action dated Dec. 31, 2014 pertaining to U.S. Appl. No. 13/605,498.
Office Action dated Dec. 16, 2014 pertaining to U.S. Appl. No. 13/653,095.
Office Action dated Dec. 19, 2014 pertaining to U.S. Appl. No. 13/652,969.
Office Action dated Dec. 29, 2014 pertaining to U.S. Appl. No. 13/833,793.
Notice of Allowance dated Feb. 2, 2015 pertaining to U.S. Appl. No. 13/795,737.
Office Action dated Feb. 25, 2015 pertaining to U.S. Appl. No. 13/605,481.
Office Action dated Feb. 18, 2015 pertaining to U.S. Appl. No. 13/827,522.
Office Action dated Mar. 19, 2015 pertaining to U.S. Appl. No. 13/795,780.
Patent Cooperation Treaty, International Search Report for PCT/US2014/037841, dated Aug. 19, 2014, 3 pages.
Office Action dated Jun. 24, 2015 pertaining to U.S. Appl. No. 13/652,969.
Patent Cooperation Treaty, International Preliminary Report on Patentability for PCT/US2013/064512, dated Apr. 30, 2015, 9 pages.
Patent Cooperation Treaty, International Preliminary Report on Patentability for PCT/US2013/064515, dated Apr. 30, 2015, 8 pages.
Office Action dated Jun. 24, 2015 pertaining to U.S. Appl. No. 14/259,703.
Office Action dated Jul. 20, 2015 pertaining to U.S. Appl. No. 14/279,870.
Office Action dated Feb. 2, 2016 pertaining to U.S. Appl. No. 14/259,703.
Office Action dated Oct. 7, 2015 pertaining to U.S. Appl. No. 13/927,537.
Search Report dated Oct. 7, 2014 pertaining to International application No. PCT/US2014/043311.
Report on the Filing or Determination of an Action Regarding a Patent or Trademark regarding U.S. Pat. Nos. 8,313,353; 8,313,345; 8,323,060—Eastern District of Arkansas.
Report on the Filing or Determination of an Action Regarding a Patent or Trademark regarding U.S. Pat. Nos. 8,192,237; 8,287,320; 8,313,353; 8,323,060—Northern District of New York.
Report on the Filing or Determination of an Action Regarding a Patent or Trademark regarding U.S. Pat. No. 8,562,366—Northern District of New York.
Office Action dated Mar. 10, 2016 pertaining to U.S. Appl. No. 14/166,653.
European Search Report dated Apr. 8, 2015 pertaining to European Patent Application No. 13733586.5.
Search Report dated Mar. 19, 2013 pertaining to International application No. PCT/US2013/20001.
Office Action dated Feb. 29, 2016 pertaining to U.S. Appl. No. 14/795,367.
Office Action dated May 3, 2016 pertaining to U.S. Appl. No. 14/750,435.
Office Action dated May 20, 2016 pertaining to U.S. Appl. No. 13/927,537.
Chinese Search Report dated Jan. 19, 2016 pertaining to Chinese Application No. 2013800048358.

(56) References Cited

OTHER PUBLICATIONS

Taiwan Search Report dated Mar. 28, 2016 pertaining to Taiwanese Application No. 102100147.
Office Action dated Aug. 26, 2016 pertaining to U.S. Appl. No. 15/019,498.
Office Action dated Sep. 1, 2016 pertaining to U.S. Appl. No. 14/259,703.
Office Action dated Sep. 23, 2016 pertaining to U.S. Appl. No. 14/872,842.
Notice of Allowance dated Sep. 23, 2016 pertaining to U.S. Appl. No. 13/927,537.
Notice of Allowance dated Sep. 19, 2016 pertaining to U.S. Appl. No. 14/928,552.
Office Action dated Jul. 5, 2016 pertaining to U.S. Appl. No. 14/795,367.
Office Action dated Nov. 7, 2016 pertaining to U.S. Appl. No. 15/278,825.
Corning Cablecon CX3 Compression Catalogue; Rev. May 2012; 16 pages.
International Search Report and Written Opinion of the International Searching Authority; PCT/US2016/017294; dated May 11, 2016.
TW102137009 Search Report dated Sep. 26, 2016; 1 page, Taiwan Patent Office.
Office Action dated Jan. 20, 2017 pertaining to U.S. Appl. No. 14/797,575.
Office Action dated Nov. 29, 2016 pertaining to U.S. Appl. No. 14/844,592.
Apple Rubber Products Seal Design Guide 75; Mary K. Chaffee et al eds.; 2009; available at http://www.applerubber.com/src/pdf/seal-design-guide.pdf.
Whitlock, J. et al.; The Seal Man's O'Ring Handbook; Eric Jackson ed.; EPM, Inc.; 1st ed. 2004; pp. 1-36; available at https://www.physics.harvard.edu/uploads/files/machineshop/epm_oring_handbook.pdf.
O-Ring Identification Chart; Universal Air Conditioner, Inc.; available at https://www.uacparts.com/Downloads/UAC%20Oring%20Chart.pdf.
Office Action dated Jul. 25, 2017 pertaining to U.S. Appl. No. 14/259,703.
*Ex Parte Quayle* dated May 18, 2017 pertaining to U.S. Appl. No. 15/342,709.
Office Action dated May 9, 2017 pertaining to U.S. Appl. No. 14/884,385.

* cited by examiner

COAXIAL CABLE CONNECTOR WITH INTEGRAL RADIO FREQUENCY INTERFERENCE AND GROUNDING SHIELD

RELATED APPLICATIONS

This application is a continuation of U.S. patent application Ser. No. 14/750,435 filed Jun. 25, 2015, which is a continuation of U.S. patent application Ser. No. 13/605,498 filed Sep. 6, 2012, which claims the benefit of priority under 35 U.S.C. §119 of U.S. Provisional Application Ser. No. 61/535,062 filed on Sep. 15, 2011. The content of each of these applications is relied upon and incorporated herein by reference in its entirety.

BACKGROUND

Field of the Disclosure

The disclosure relates generally to coaxial cable connectors, and particularly to coaxial cable connectors having a flexible, resilient shield integral to one or more of the components which provides radio frequency interference (RFI) and grounding shielding independent of the tightness of the coaxial cable connector to an appliance equipment connection port, and without restricting the movement of the coupler of the coaxial cable connector when being attached to the appliance equipment connection.

Technical Background

Coaxial cable connectors, such as type F connectors, are used to attach coaxial cable to another object or appliance, e.g., a television set, DVD player, modem or other electronic communication device having a terminal adapted to engage the connector. The terminal of the appliance includes an inner conductor and a surrounding outer conductor.

Coaxial cable includes a center conductor for transmitting a signal. The center conductor is surrounded by a dielectric material, and the dielectric material is surrounded by an outer conductor; this outer conductor may be in the form of a conductive foil and/or braided sheath. The outer conductor is typically maintained at ground potential to shield the signal transmitted by the center conductor from stray noise, and to maintain continuous desired impedance over the signal path. The outer conductor is usually surrounded by a plastic cable jacket that electrically insulates, and mechanically protects, the outer conductor. Prior to installing a coaxial connector onto an end of the coaxial cable, the end of the coaxial cable is typically prepared by stripping off the end portion of the jacket to expose the end portion of the outer conductor. Similarly, it is common to strip off a portion of the dielectric to expose the end portion of the center conductor.

Coaxial cable connectors of the type known in the trade as "F connectors" often include a tubular post designed to slide over the dielectric material, and under the outer conductor of the coaxial cable, at the prepared end of the coaxial cable. If the outer conductor of the cable includes a braided sheath, then the exposed braided sheath is usually folded back over the cable jacket. The cable jacket and folded-back outer conductor extend generally around the outside of the tubular post and are typically received in an outer body of the connector; this outer body of the connector is often fixedly secured to the tubular post. A coupler is typically rotatably secured around the tubular post and includes an internally-threaded region for engaging external threads formed on the outer conductor of the appliance terminal.

When connecting the end of a coaxial cable to a terminal of a television set, equipment box, or other appliance, it is important to achieve a reliable electrical connection between the outer conductor of the coaxial cable and the outer conductor of the appliance terminal. Typically, this goal is usually achieved by ensuring that the coupler of the connector is fully tightened over the connection port of the appliance. When fully tightened, the head of the tubular post of the connector directly engages the edge of the outer conductor of the appliance port, thereby making a direct electrical ground connection between the outer conductor of the appliance port and the tubular post; in turn, the tubular post is engaged with the outer conductor of the coaxial cable.

With the increased use of self-install kits provided to home owners by some CATV system operators has come a rise in customer complaints due to poor picture quality in video systems and/or poor data performance in computer/internet systems. Additionally, CATV system operators have found upstream data problems induced by entrance of unwanted RF signals into their systems. Complaints of this nature result in CATV system operators having to send a technician to address the issue. Often times it is reported by the technician that the cause of the problem is due to a loose F connector fitting, sometimes as a result of inadequate installation of the self-install kit by the homeowner. An improperly installed or loose connector may result in poor signal transfer because there are discontinuities along the electrical path between the devices, resulting in ingress of undesired radio frequency ("RF") signals where RF energy from an external source or sources may enter the connector/cable arrangement causing a signal to noise ratio problem resulting in an unacceptable picture or data performance. Many of the current state of the art F connectors rely on intimate contact between the F male connector interface and the F female connector interface. If, for some reason, the connector interfaces are allowed to pull apart from each other, such as in the case of a loose F male coupler, an interface "gap" may result. If not otherwise protected this gap can be point of RF ingress as previously described.

As mentioned above, the coupler is rotatably secured about the head of the tubular post. The head of the tubular post usually includes an enlarged shoulder, and the coupler typically includes an inwardly-directed flange for extending over and around the shoulder of the tubular post. In order not to interfere with free rotation of the coupler, manufacturers of such F-style connectors routinely make the outer diameter of the shoulder (at the head of the tubular post) of smaller dimension than the inner diameter of the central bore of the coupler. Likewise, manufacturers routinely make the inner diameter of the inwardly-directed flange of the coupler of larger dimension than the outer diameter of the non-shoulder portion of the tubular post, again to avoid interference with rotation of the coupler relative to the tubular post. In a loose connection system, wherein the coupler of the coaxial connector is not drawn tightly to the appliance port connector, an alternate ground path may fortuitously result from contact between the coupler and the tubular post, particularly if the coupler is not centered over, and axially aligned with, the tubular post. However, this alternate ground path is not stable, and can be disrupted as a result of vibrations, movement of the appliance, movement of the cable, or the like.

Alternatively, there are some cases in which such an alternate ground path is provided by fortuitous contact between the coupler and the outer body of the coaxial connector, provided that the outer body is formed from conductive material. This alternate ground path is similarly unstable, and may be interrupted by relative movement between the appliance and the cable, or by vibrations. Moreover, this alternate ground path does not exist at all if the outer body of the coaxial connector is constructed of non-conductive material. Such unstable ground paths can give rise to intermittent failures that are costly and time-consuming to diagnose.

SUMMARY OF THE DETAILED DESCRIPTION

One embodiment includes a coaxial cable connector for coupling a coaxial cable to an equipment port. The coaxial cable includes a center conductor surrounded by a dielectric material, the dielectric material being surrounded by an outer conductor. The coaxial cable connector comprises a tubular post a coupler and a body. The tubular post has a first end adapted to be inserted into the prepared end of the coaxial cable between the dielectric material and the outer conductor, and a second end opposite the first end thereof. The coupler has a first end rotatably secured over the second end of the tubular post, and an opposing second end. The coupler includes a central bore extending therethrough. A portion of the central bore is proximate the second end of the coupler and adapted for engaging the equipment port. The body is secured to the tubular post and extends about the first end of the tubular post for receiving the outer conductor of the coaxial cable. A portion of at least one of the tubular post, the coupler and the body member provides a spring-like force on the surface of at least one of the other of the tubular post, the coupler and the body member to establish an electrically conductive path therebetween. The portion maintains the electrically conductive path between the coaxial cable conductor and an equipment connection port of an appliance when the coupler is loosened from while in contact with the equipment connection port, and provides for unrestricted rotation of the coupler.

The portion may be integral to the at least one of the tubular post, the coupler and the body and may comprise at least one pre-formed cantilevered beam, or a plurality of pre-formed cantilevered annular beams. The pre-formed cantilevered annular beam may be arcuately shaped, and may comprise an outer surface with an edge. The edge may have a knife-like sharpness and provide a wiping action of surface oxides on the other of the tubular post, the coupler and the body. The at least one pre-formed cantilevered annular beam may be resilient relative to the longitudinal axis of the connector and maintain an arcuately increased surface of sliding electrical contact to the at least one of the other of the tubular post, the coupler and the body. Further, the portion may comprise a circular inner segment. The circular inner segment and the pre-formed annular beam may be metallic, and may be formed of phosphor bronze. The portion comprises a conductive material plating with the conductive material plating being one of tin and tin-nickel.

Another embodiment includes a coaxial cable connector for coupling a coaxial cable to an equipment port. The coaxial cable includes a center conductor surrounded by a dielectric material, the dielectric material being surrounded by an outer conductor. The coaxial cable connector comprises a tubular post a coupler and a body. The tubular post has a first end adapted to be inserted into the prepared end of the coaxial cable between the dielectric material and the outer conductor, and a second end opposite the first end thereof. The coupler has a first end rotatably secured over the second end of the tubular post, and an opposing second end. The coupler includes a central bore extending therethrough. A portion of the central bore is proximate the second end of the coupler and adapted for engaging the equipment port. The body is secured to the tubular post and extends about the first end of the tubular post for receiving the outer conductor of the coaxial cable.

A resilient, electrically-conductive integral shield element having an inner segment and at least one pre-formed cantilevered annular beam attached to the inner segment may be disposed proximate to and in contact with the body. The at least one pre-formed cantilevered annular beam exerts a spring-like force on the coupler, such that the integral shield element provides an electrically-conductive path between the body and the coupler. The integral shield element remains captured and secured and provides the electrically-conductive path independent of the tightness of the coaxial cable connector. The integral shield element may be generally circular and the at least one pre-formed cantilevered annular beam may be arcuately shaped. The second end of the tubular post may have an enlarged shoulder comprising a first rearward facing annular shoulder and a second rearward facing annular shoulder. The coupler may comprise a rearward facing annular surface, and the at least one pre-formed cantilevered annular beam exerts a spring-like force on the coupler at the rearward facing annular surface.

The integral shield element may be resilient relative to the longitudinal axis of the connector and maintains an arcuately increased surface of sliding electrical contact between the integral shield element and the rearward facing annular surface of the coupler. The at least one pre-formed cantilevered annular beam may comprise an outer surface with an edge, and wherein the edge has a knife-like sharpness and provides a wiping action of surface oxides on a surface of the coupler. The integral shield element provides for unrestricted rotation of the coupler and maintains the electrically conductive path between the coaxial cable conductor and an equipment connection port of an appliance when the coupler is loosened from while in contact with the equipment connection port and, therefore, provides the electrically-conductive path independent of the tightness of the coaxial cable connector.

The body and the post may be in intimate electrical and mechanical communication by means of a press-fit between corresponding conductive surfaces. The integral shield element provides an electrically conductive path between the body and the coupler providing a shield against RF ingress. The coaxial cable connector couples a prepared end of a coaxial cable to a threaded female equipment port. The tubular post has a first end adapted to be inserted into the prepared end of the coaxial cable between the dielectric material and the outer conductor thereof. The coupler is rotatably attached over a second end of the tubular post. The coaxial cable connector includes a central bore, at least a portion of which is threaded for engaging the female equipment port. The body extends about the first end of the tubular post for receiving the outer conductor, and preferably the cable jacket, of the coaxial cable.

A resilient, electrically-conductive integral shield element comprises a portion of one or more of the connector components and bridges between the said components. This integral shield element engages both the body and the coupler and, alternatively, the post for providing an electrically-conductive path therebetween, but without noticeably restricting rotation of the coupler relative to the tubular post. The integral shield element may be generally circular and includes a plurality of pre-formed flexible annular cantilevered beams. The tubular post comprises an enlarged shoulder extending inside the coupler with a first rearward facing annular shoulder and a stepped diameter leading to a second rearward facing annular shoulder. Alternatively, the post may comprise an integral shield element. As a further alternative, the post may be used in conjunction with a snap ring to retain the coupler. The coupler comprises a forward facing annular surface, a through-bore and a rearward facing annular surface. The body at least partially comprises an integral shield element, a face, a through bore and an external annular surface. In a preferred embodiment the integral shield element is proximate one end of the body and contacts the rearward facing annular surface of the coupler. The pre-formed flexible cantilevered annular beam(s) of the integral shield element are at least partially disposed against the rearward facing annular surface of the coupler. The integral shield element is resilient relative to the longitudinal axis of the connector and maintains an arcuately increased surface of sliding electrical contact between the integral shield element and the rearward facing annular surface of the coupler. At the same time the integral shield element is integral to the body providing electrical and mechanical communication between the coupler, and the body while allowing smooth and easy rotation of the coupler. The coaxial cable connector may also include a sealing ring seated within the coupler for rotatably engaging the body to form a seal therebetween.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION OF THE DRAWINGS

Figure 1:
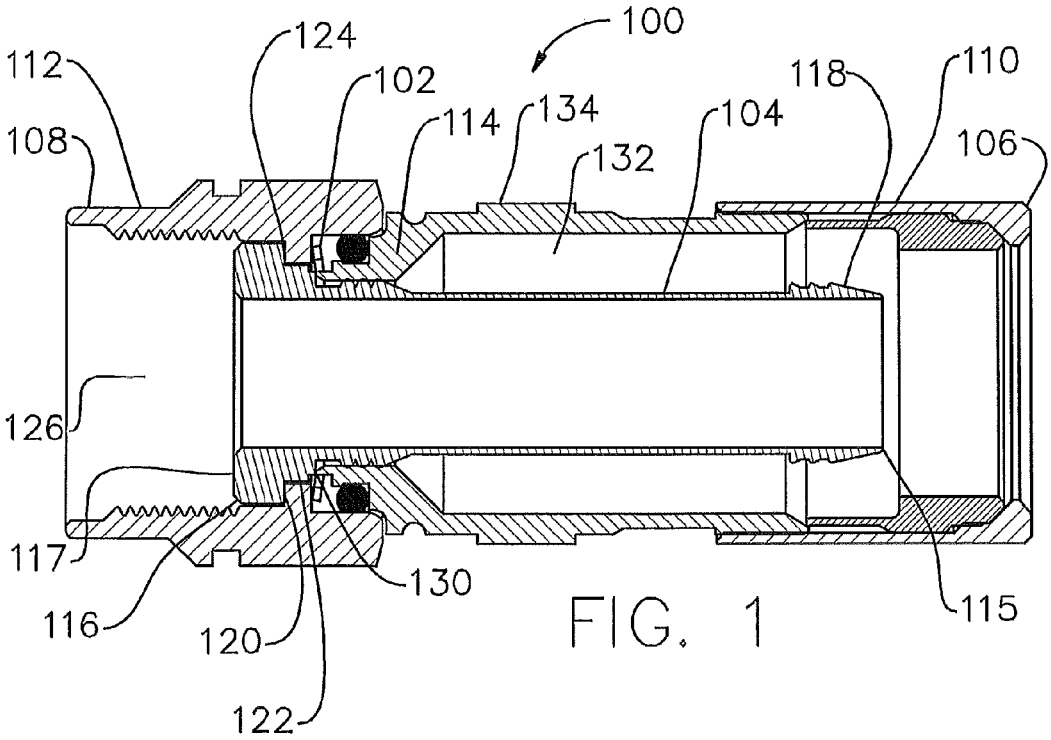
FIG. 1 is a cross sectional view of an embodiment of a type of a coaxial connector comprising a body with an integral shield element as disclosed herein.

Reference will now be made in detail to the embodiments, examples of which are illustrated in the accompanying drawings, in which some, but not all embodiments are shown. Indeed, the concepts may be embodied in many different forms and should not be construed as limiting herein; rather, these embodiments are provided so that this disclosure will satisfy applicable legal requirements. Whenever possible, like reference numbers will be used to refer to like components or parts.

Coaxial cable connectors are used to couple a prepared end of a coaxial cable to a threaded female equipment connection port of an appliance. The coaxial cable connector may have a post or may be postless. In both cases though, in addition to providing an electrical and mechanical connection between the conductor of the coaxial connector and the conductor of the female equipment connection port, the coaxial cable connector provides a ground path from the braided sheath of the coaxial cable to the equipment connection port. Maintaining a stable ground path protects against the ingress of undesired radio frequency ("RF") signals which may degrade performance of the appliance. This is especially applicable when the coaxial cable connector is loosened from the equipment connection port, either due to not being tightened upon initial installation or due to becoming loose after installation.

One embodiment includes a coaxial cable connector for coupling a coaxial cable to an equipment port. The coaxial cable includes a center conductor surrounded by a dielectric material, the dielectric material being surrounded by an outer conductor. The coaxial cable connector comprises a tubular post a coupler and a body. The tubular post has a first end adapted to be inserted into the prepared end of the coaxial cable between the dielectric material and the outer conductor, and a second end opposite the first end thereof. The coupler has a first end rotatably secured over the second end of the tubular post, and an opposing second end. The coupler includes a central bore extending therethrough. A portion of the central bore is proximate the second end of the coupler and adapted for engaging the equipment port. The body is secured to the tubular post and extends about the first end of the tubular post for receiving the outer conductor of the coaxial cable. A portion of at least one of the tubular post, the coupler and the body member provides a spring-like force on the surface of at least one of the other of the tubular post, the coupler and the body member to establish an electrically conductive path therebetween. The portion maintains the electrically conductive path between the coaxial cable conductor and an equipment connection port of an appliance when the coupler is loosened from while in contact with the equipment connection port, and provides for unrestricted rotation of the coupler.

The portion may be integral to the at least one of the tubular post, the coupler and the body and may comprise at least one pre-formed cantilevered beam, or a plurality of pre-formed cantilevered annular beams. The pre-formed cantilevered annular beam may be arcuately shaped, and may comprise an outer surface with an edge. The edge may have a knife-like sharpness and provide a wiping action of surface oxides on the other of the tubular post, the coupler and the body. The at least one pre-formed cantilevered annular beam may be resilient relative to the longitudinal axis of the connector and maintain an arcuately increased surface of sliding electrical contact to the at least one of the other of the tubular post, the coupler and the body. Further, the portion may comprise a circular inner segment. The circular inner segment and the pre-formed annular beam may be metallic, and may be formed of phosphor bronze. The portion comprises a conductive material plating with the conductive material plating being one of tin and tin-nickel.

Another embodiment includes a coaxial cable connector for coupling a coaxial cable to an equipment port. The coaxial cable includes a center conductor surrounded by a dielectric material, the dielectric material being surrounded by an outer conductor. The coaxial cable connector comprises a tubular post a coupler and a body. The tubular post has a first end adapted to be inserted into the prepared end of the coaxial cable between the dielectric material and the outer conductor, and a second end opposite the first end thereof. The coupler has a first end rotatably secured over the second end of the tubular post, and an opposing second end. The coupler includes a central bore extending therethrough. A portion of the central bore is proximate the second end of the coupler and adapted for engaging the equipment port. The body is secured to the tubular post and extends about the first end of the tubular post for receiving the outer conductor of the coaxial cable.

A resilient, electrically-conductive integral shield element having an inner segment and at least one pre-formed cantilevered annular beam attached to the inner segment may be disposed proximate to and in contact with the body. The at least one pre-formed cantilevered annular beam exerts a spring-like force on the coupler, such that the integral shield element provides an electrically-conductive path between the body and the coupler. The integral shield element remains captured and secured and provides the electrically-conductive path independent of the tightness of the coaxial cable connector. The integral shield element may be generally circular and the at least one pre-formed cantilevered annular beam may be arcuately shaped. The second end of the tubular post may have an enlarged shoulder comprising a first rearward facing annular shoulder and a second rearward facing annular shoulder. The coupler may comprise a rearward facing annular surface, and the at least one pre-formed cantilevered annular beam exerts a spring-like force on the coupler at the rearward facing annular surface.

The integral shield element may be resilient relative to the longitudinal axis of the connector and maintains an arcuately increased surface of sliding electrical contact between the integral shield element and the rearward facing annular surface of the coupler. The at least one pre-formed cantilevered annular beam may comprise an outer surface with an edge, and wherein the edge has a knife-like sharpness and provides a wiping action of surface oxides on a surface of the coupler. The integral shield element provides for unrestricted rotation of the coupler and maintains the electrically conductive path between the coaxial cable conductor and an equipment connection port of an appliance when the coupler is loosened from while in contact with the equipment connection port and, therefore, provides the electrically-conductive path independent of the tightness of the coaxial cable connector.

The body and the post may be in intimate electrical and mechanical communication by means of a press-fit between corresponding conductive surfaces. The integral shield element provides an electrically conductive path between the body and the coupler providing a shield against RF ingress. The coaxial cable connector couples a prepared end of a coaxial cable to a threaded female equipment port. The tubular post has a first end adapted to be inserted into the prepared end of the coaxial cable between the dielectric material and the outer conductor thereof. The coupler is rotatably attached over a second end of the tubular post. The coaxial cable connector includes a central bore, at least a portion of which is threaded for engaging the female equipment port. The body extends about the first end of the tubular post for receiving the outer conductor, and preferably the cable jacket, of the coaxial cable.

A resilient, electrically-conductive integral shield element comprises a portion of one or more of the connector components and bridges between the said components. This integral shield element engages both the body and the coupler and, alternatively, the post for providing an electrically-conductive path therebetween, but without noticeably restricting rotation of the coupler relative to the tubular post. The integral shield element may be generally circular and includes a plurality of pre-formed flexible annular cantilevered beams. The tubular post comprises an enlarged shoulder extending inside the coupler with a first rearward facing annular shoulder and a stepped diameter leading to a second rearward facing annular shoulder. Alternatively, the post may comprise an integral shield element. As a further alternative, the post may be used in conjunction with a snap ring to retain the coupler. The coupler comprises a forward facing annular surface, a through-bore and a rearward facing annular surface. The body at least partially comprises an integral shield element, a face, a through bore and an external annular surface. In a preferred embodiment the integral shield element is proximate one end of the body and contacts the rearward facing annular surface of the coupler. The pre-formed flexible cantilevered annular beam(s) of the integral shield element are at least partially disposed against the rearward facing annular surface of the coupler. The integral shield element is resilient relative to the longitudinal axis of the connector and maintains an arcuately increased surface of sliding electrical contact between the integral shield element and the rearward facing annular surface of the coupler. At the same time the integral shield element is integral to the body providing electrical and mechanical communication between the coupler, and the body while allowing smooth and easy rotation of the coupler. The coaxial cable connector may also include a sealing ring seated within the coupler for rotatably engaging the body to form a seal therebetween.

Figure 1A:
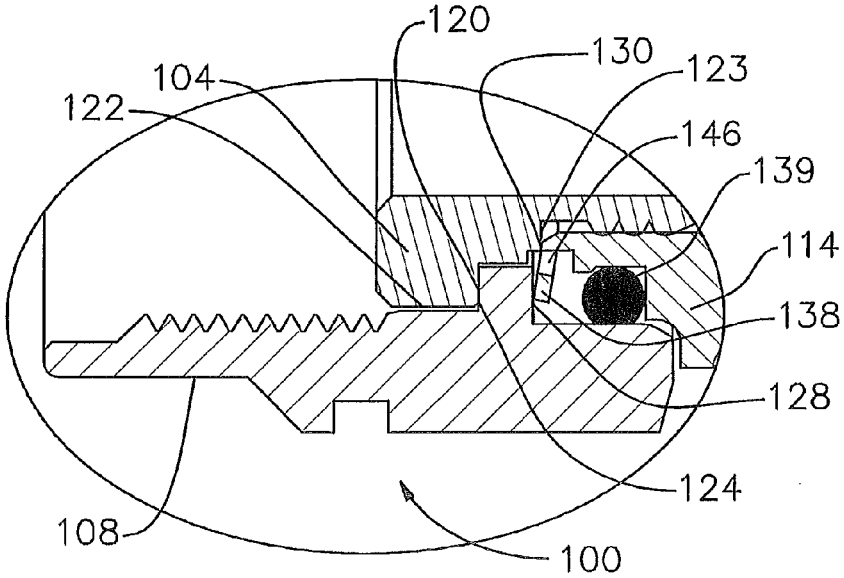
FIG. 1A is a detail section of a portion of FIG. 1.

In this regard, FIGS. 1 and 1A illustrates an exemplary embodiment of coaxial cable connector 100 having body 114 comprising an integral shield element 102 to provide a stable ground path and protect against the ingress of RF signals. The coaxial cable connector 100 is shown in its unattached state, without a coaxial cable inserted therein. The coaxial cable connector 100 couples a prepared end of a coaxial cable to a threaded female equipment connection port (not shown in FIG. 1). This will be discussed in more detail with reference to FIG. 7. The coaxial cable connector 100 has a first end 106 and a second end 108. A shell 110 slidably attaches to the coaxial cable connector at the first end 106. A coupler 112 attaches to the coaxial cable connector 100 at the second end 108. The coupler 112 may rotatably attach to the second end 108, and, thereby, also to the tubular post 104. The integral shield element 102 is a unitized portion of the body 114 of the coaxial connector 100. In this way, the integral shield element 102 provides an electrically conductive path between the body 114, and the coupler 112. This enables an electrically conductive path from the coaxial cable through the coaxial cable connector 100 to the equipment connection port providing an electrical ground and a shield against RF ingress.

Continuing with reference to FIGS. 1 and 1A, the tubular post 104 has a first end 115 which is adapted to extend into a coaxial cable and a second end 117. An enlarged shoulder 116 at the second end 117 extends inside the coupler 112. At the first end 115, the tubular post 104 has a circular barb 118 extending radially outwardly from the tubular post 104. The enlarged shoulder 116 comprises a first rearward facing annular shoulder 120, and a stepped diameter 122 leading to a second rearward facing annular shoulder 123. The coupler 112 comprises a forward facing annular surface 124, a through-bore 126 and a rearward facing annular surface 128. The body 114 at least partially comprises an integral shield element 102, a face 130, a through bore 132 and an external annular surface 134. In this manner, the integral shield element 102 is secured within the coaxial cable connector 100, and establishes an electrically conductive path between the body 114 and the coupler 112. Further, the integral shield element 102 remains secured independent of the tightness of the coaxial cable connector 100 on the appliance equipment connection port. In other words, the integral shield element 102 remains secured and the electrically conductive path remains established between the body 114 and the coupler 112 even when the coaxial cable connector is loosened and/or disconnected from the appliance equipment connection port. Additionally, the integral shield element 102 has resilient and flexible cantilevered annular beams 138 disposed against the rearward facing annular surface 128 of the coupler 112. In this manner, the cantilevered annular beams 138 maintain contact with the coupler independent of tightness of the coaxial cable connector 100 on the appliance equipment connection port without restricting the movement, including the rotation of the coupler 112. The coaxial cable connector 100 may also include a sealing ring 139 seated within the coupler 112 to form a seal between the coupler 112 and the body 114.

Figure 2:
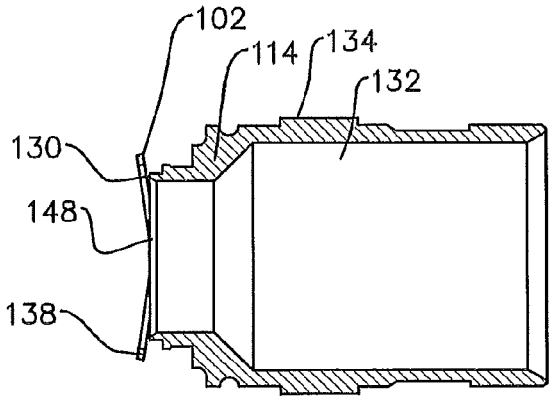
FIG. 2 is a side cross sectional view of the body with the integral shield element.
Figure 2A:
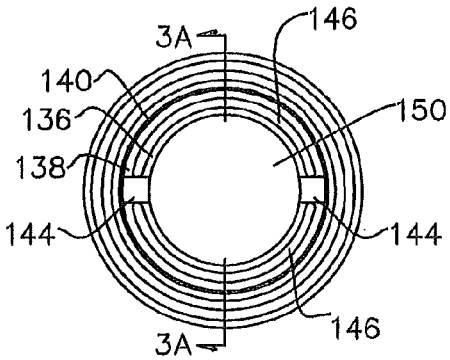
FIG. 2A is a front schematic view of the body with the integral shield element.
Figure 2B:
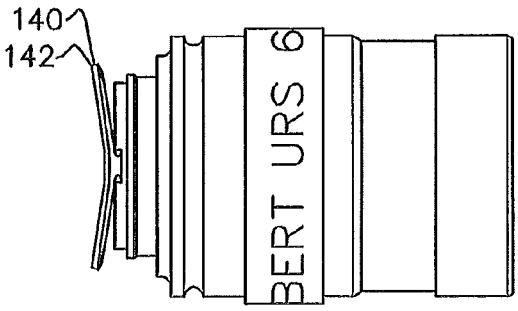
FIG. 2B is a side schematic view of the body with the integral shield element.

Referring now to FIGS. 2, 2A and 2B, the integral shield element 102 may be circular with the inner segment 136 and at least one pre-formed cantilevered annular beam 138. The least one pre-formed cantilevered annular beam 138 is flexible, arcuately shaped and extends at approximately a 19° angle from the plane of the inner segment 136. The pre-formed cantilevered annular beam 138 has an outer surface 140 with an edge 142, as shown in FIG. 2B. Joining segment 144 joins the pre-formed cantilevered annular beam 138 to the inner segment 136 forming a slot 146 therebetween. The inner segment 136 has an inner surface 148 that defines a central aperture 150. Body 114 and therefore integral shield element 102 may be made from a metallic material, including as a non-limiting examples, brass or phosphor bronze, additionally or alternatively, the integral shield element 102 may be un-plated or plated with a conductive material, as non-limiting examples tin, tin-nickel or the like.

Pre-forming the cantilevered annular beams 138 as illustrated in FIGS. 2 and 2B, provides the technical advantage of improved application of the material properties of the integral shield element 102 to provide a spring force biasing the edge 142 toward the rearward facing annular surface 128 and causing the edge 142 of outer surface 140 to intimately contact rearward facing annular surface 128 of the coupler 112. Because of this, the integral shield element 102 may be manufactured without having to utilize a more expensive material such as beryllium copper. Additionally, the material of the integral shield element 102 does not need to be heat treated. Further, the natural spring-like qualities of the selected material are utilized, with the modulus of elasticity preventing the integral shield element 102 from being overstressed by providing for limited relative axial movement between coupler 112, the tubular post 104 and the body 114.

Electrical grounding properties are enhanced by providing an arcuately increased area of surface engagement between the edges 142 of the cantilevered annular beams 138 and rearward facing annular surface 128 of coupler 112 as compared, for example, to the amount of surface engagement of individual, limited number of contact points, such as raised bumps and the like. In this manner, the increased area of surface engagement provides the opportunity to engage a greater number of Asperity spots ("A-spots") rather than relying on the limited number of mechanical and A-spot points of engagement. Additionally, the edge 142 may have a knife-like sharpness. Thus, the knife-like sharpness of the edge 142 makes mechanical contact between the cantilevered annular beams 138 and rearward facing annular surface 128 of coupler 112 without restricting the movement of the coupler 112. Also, the knife-like sharpness of the edge 142 and the plating of integral shield element 102 provide a wiping action of surface oxides to provide for conductivity during periods of relative motion between the components.

Moreover, in addition to the increased number of A-spot engagement, the increased area of surface engagement results in an increased area of concentrated, mechanical pressure. While providing the degree of surface contact and concentrated mechanical force, the integral shield element 102 does not negatively impact the "feel" of coupler rotation due to the limited amount of frictional drag exerted by the profile of edges 142 against reward facing annular surface 128.

The integral shield element 102 is resilient relative to the longitudinal axis of the coaxial cable connector 100 and maintains an arcuately increased surface of sliding electrical contact between integral shield element 102 and the rearward facing annular surface 128 of the coupler 112. At the same time the integral shield element 102, being part of the body 114, is firmly grounded through the body 114 providing assured electrical and mechanical communication between the coupler 112, and the body 114 while allowing smooth and easy rotation of the coupler 112.

Figure 3:
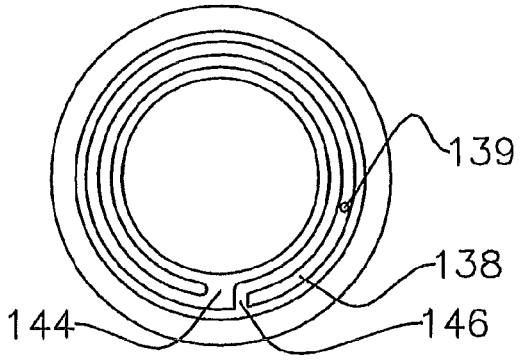
FIGS. 3 through 3D inclusive are front schematic views of alternate embodiments of the body with the integral shield element.
Figure 3A:
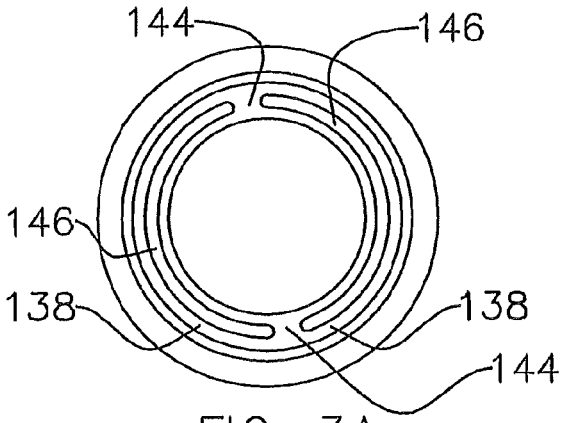
Figure 3B:
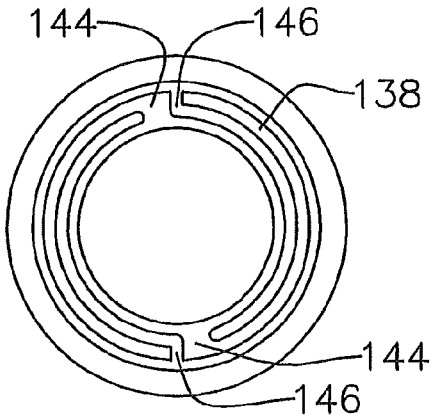
Figure 3C:
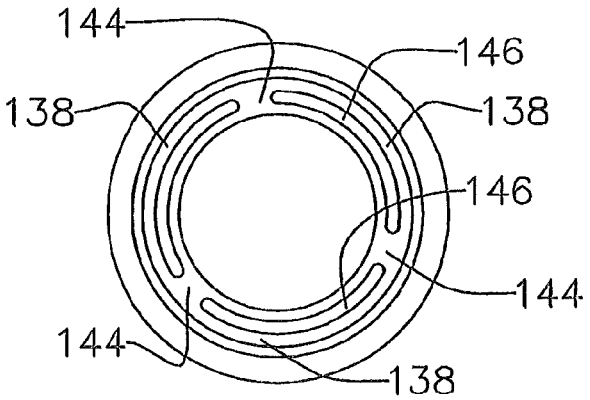
Figure 3D:
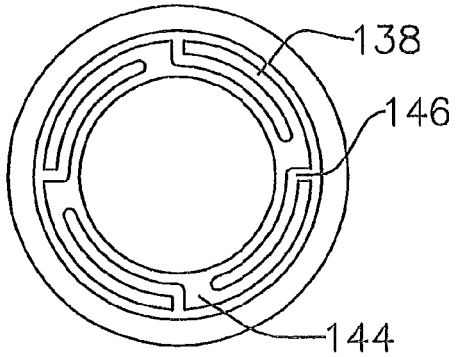

FIGS. 3 through 3D illustrate optional embodiments of the integral shield element 102 with differing patterns of slots 146, cantilevered annular beams 138, and the joining segments 144. Slots 146 may break through one side of the cantilevered beams 138 forming a single ended cantilevered beam or, alternatively, may not break out through one side of the cantilevered beam forming a double ended cantilevered beam. Endless variations and patterns may be achieved. Additionally and optionally, one or more of the beams may comprise one or more outwardly distended protuberances or bumps 139 as illustrated in FIG. 3

Figure 4:
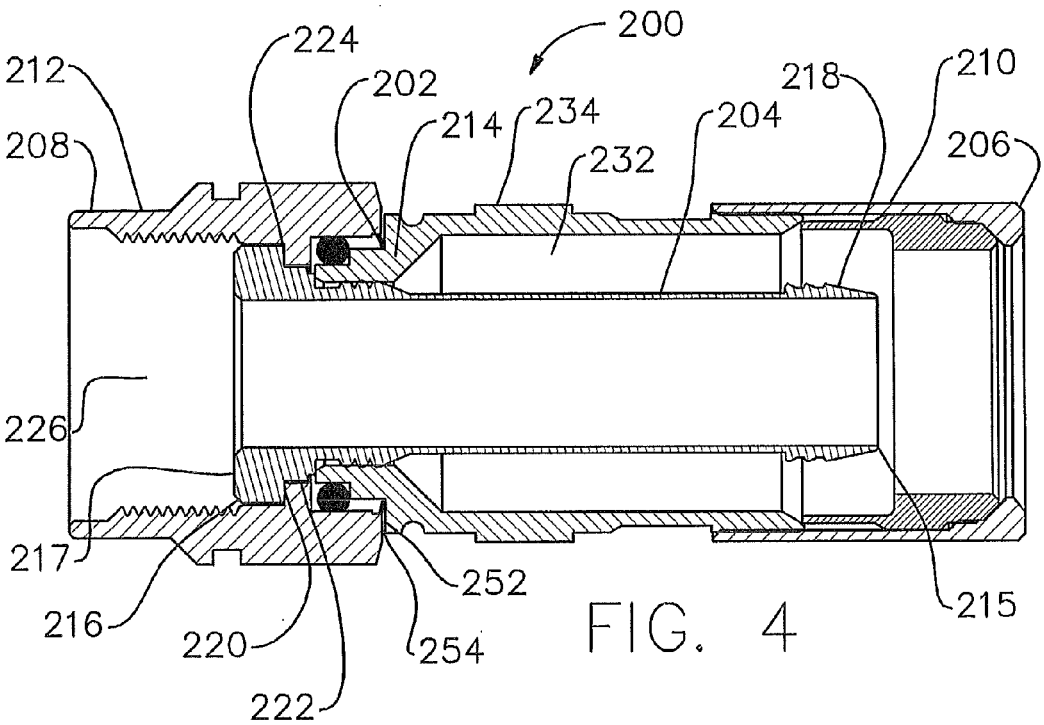
FIG. 4 is a cross sectional view of an embodiment of a type of a coaxial connector comprising a coupler with an integral shield element as disclosed herein.
Figure 4A:
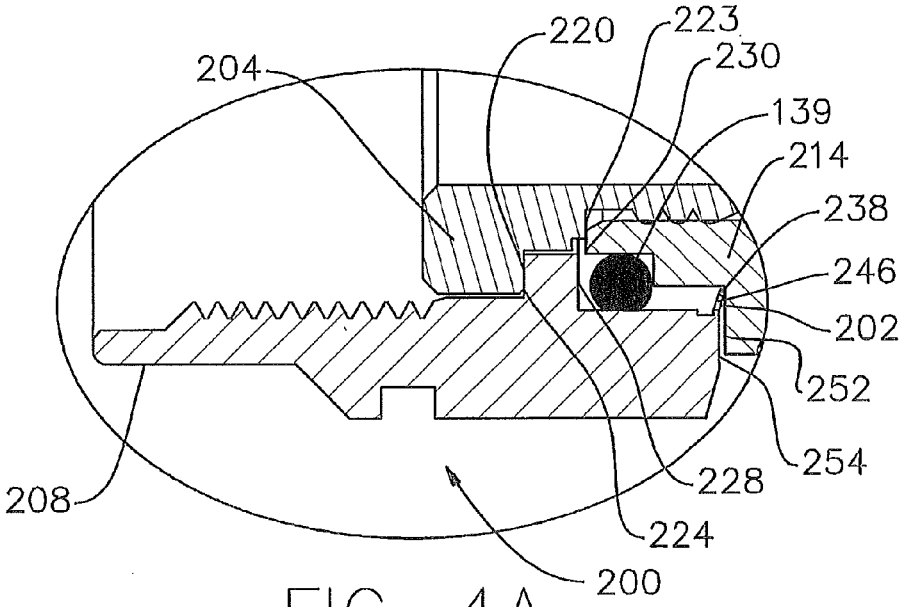
FIG. 4A is a detail section of a portion of FIG. 4.

Referring now to FIGS. 4 and 4A, illustrate an exemplary embodiment of coaxial cable connector 200 having coupler 212 comprising an integral shield element 202 to provide a stable ground path and protect against the ingress of RF signals. The tubular post 204 has a first end 215 which is adapted to extend into a coaxial cable and a second end 217. An enlarged shoulder 216 at the second end 217 extends inside the coupler 212. At the first end 215, the tubular post 204 has a circular barb 218 extending radially outwardly from the tubular post 204. The enlarged shoulder 216 comprises a first rearward facing annular shoulder 220, a stepped diameter 222 leading to a second rearward facing annular shoulder 223. The coupler 212 comprises a forward facing annular surface 224, a through-bore 226, a rearward facing annular surface 228, an integral shield element 202 and a rear face 254. The body 214 at least partially comprises a face 230, a through bore 232 and an external annular surface 234 and a forward facing annular surface 252. Body 214 engages post 204 by means of a press fit between corresponding conductive surfaces. The integral shield element 202 of coupler 212 establishes an electrically conductive path between the coupler 212 and the forward facing annular surface 252 of body 214. Further, the integral shield element 202 remains in contact with forward facing annular surface 252 of body 214 independent of the tightness of the coaxial cable connector 200 on the appliance equipment connection port. In other words, the integral shield element 202 remains secured and the electrically conductive path remains established between the coupler 212 and the body 214 even when the coaxial cable connector is loosened and/or disconnected from the appliance equipment connection port. Additionally, the integral shield element 202 has resilient and flexible cantilevered annular beams 238 disposed against the forward facing annular surface 252 of the body 214. In this manner, the cantilevered annular beams 238 maintain contact with the post independent of tightness of the coaxial cable connector 200 on the appliance equipment connection port without restricting the movement, including the rotation of the coupler 212. The coaxial cable connector 200 may also include a sealing ring 139 seated within the coupler 212 to form a seal between the coupler 212 and the body 214.

Figure 5:
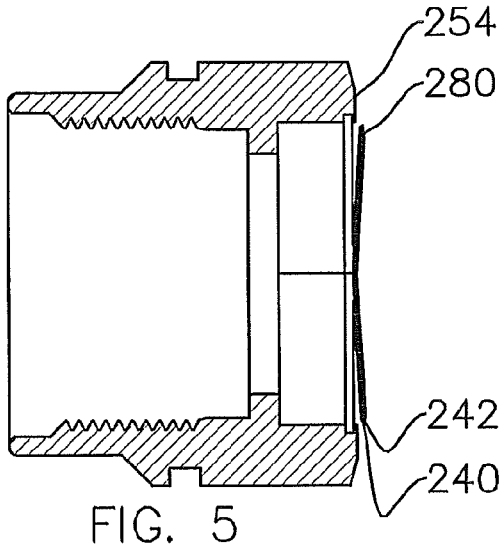
FIG. 5 is a side cross sectional view of the coupler with the integral shield element.
Figure 5A:
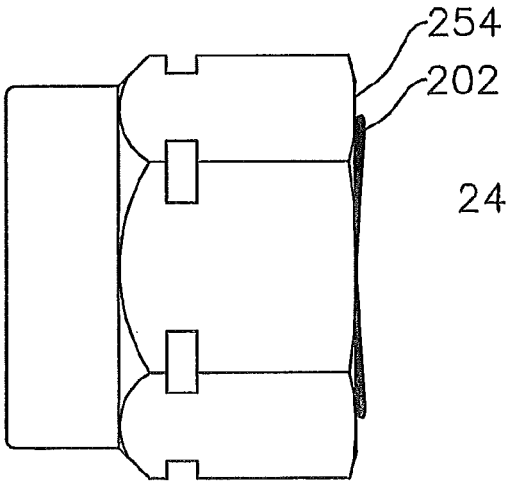
FIG. 5A is a side schematic view of the coupler with the integral shield element.
Figure 5B:
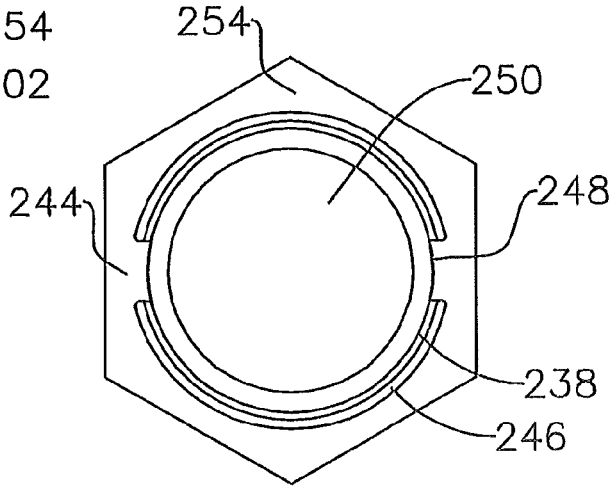
FIG. 5B is a rear schematic view of the coupler with the integral shield element.

FIGS. 5 through 5A illustrate the coupler from connector 200 in FIGS. 4 and 4A wherein FIG. 5 is a side cross sectional view of the coupler with the integral shield element, FIG. 5A is a side schematic view of the coupler with the integral shield element and FIG. 5B is a rear schematic view of the coupler with the integral shield element. The integral shield element 202 of coupler 212 may be circular with the slot 246 and at least one pre-formed cantilevered annular beam 238. The least one pre-formed cantilevered annular beam 238 is flexible, arcuately shaped and extends at approximately a 19° angle from the plane of rear face 254. The pre-formed cantilevered annular beam 238 has an outer surface 240 with an edge 242, as shown in FIG. 2B. Joining segment 244 joins the pre-formed cantilevered annular beam 238 to the rear face 254 forming a slot 246 therebetween. Inner surface 248 defines a central aperture 250. Coupler 212 and therefore integral shield element 202 may be made from a metallic material, including as a non-limiting examples, brass or phosphor bronze, additionally or alternatively, the integral shield element 202 may be un-plated or plated with a conductive material, as non-limiting examples tin, tin-nickel or the like.

Figure 6:
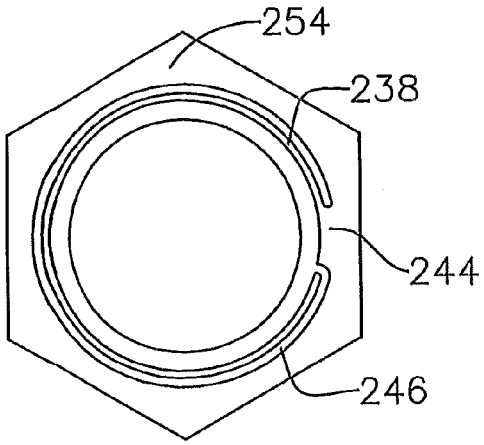
FIGS. 6 through 6D inclusive are rear schematic views of alternate embodiments of the coupler with the integral shield element.
Figure 6A:
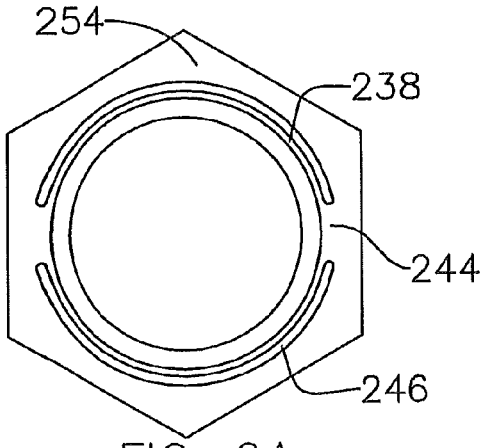
Figure 6B:
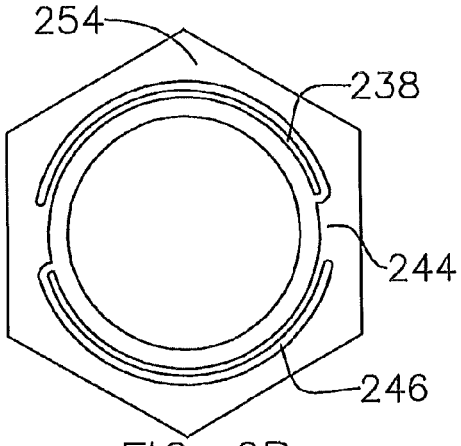
Figure 6C:
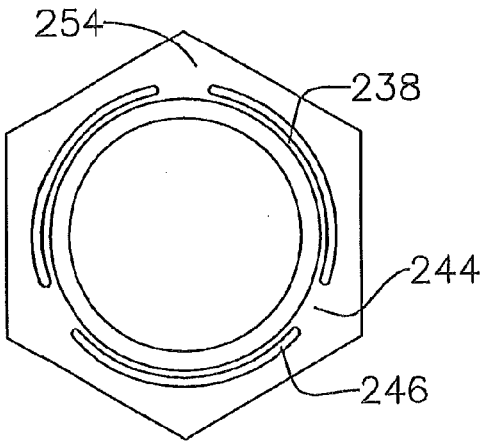
Figure 6D:
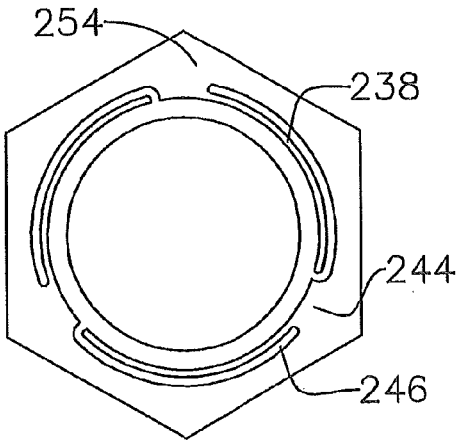

FIGS. 6 through 6D illustrate optional embodiments of the coupler 212 with integral shield element 202 with differing patterns of slots 246, cantilevered annular beams 238, and the joining segments 244. Slots 246 may break through one side of the cantilevered beams 238 forming a single ended cantilevered beam or, alternatively, may not break out through one side of the cantilevered beam forming a double ended cantilevered beam. Endless variations and patterns may be achieved.

Figure 7:
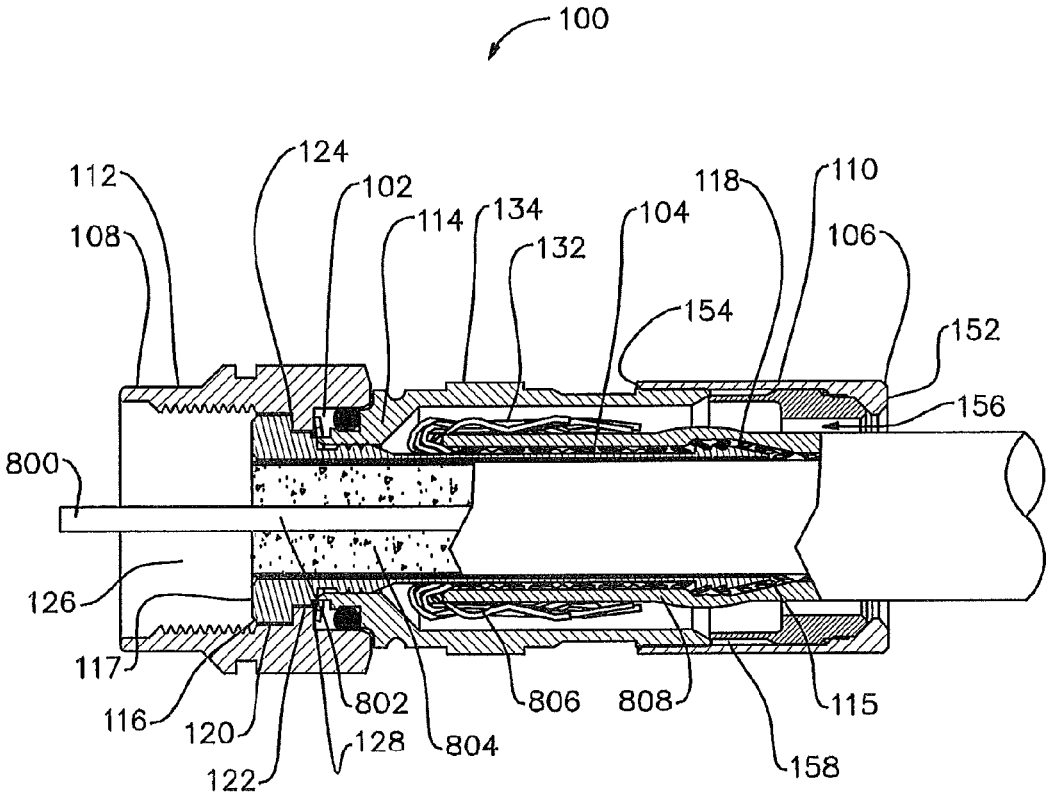
FIG. 7 is a cross sectional view of the coaxial connector of FIG. 1 with a coaxial cable disposed therein.

Referring now to FIG. 7, the coaxial cable connector 100 is shown with a coaxial cable 800 inserted therein. The shell 106 has a first end 152 and an opposing second end 154. The shell 106 may be made of metal. A central passageway 156 extends through the shell 106 between first end 152 and the second end 154. The central passageway 156 has an inner wall 158 with a diameter commensurate with the outer diameter of the external annular surface 134 of the body 112 for allowing the second end 154 of the shell 106 to extend over the body 112. A gripping ring or member 160 (hereinafter referred to as "gripping member") is disposed within the central passageway 156 of the shell 106. The central passageway 156 proximate the first end 152 of shell 106 has an inner diameter that is less than the diameter of the inner wall 158.

The coaxial cable 800 has center conductor 802. The center conductor 802 is surrounded by a dielectric material 804, and the dielectric material 804 is surrounded by an outer conductor 806 that may be in the form of a conductive foil and/or braided sheath. The outer conductor 806 is usually surrounded by a plastic cable jacket 808 that electrically insulates, and mechanically protects, the outer conductor. A prepared end of the coaxial cable 800 is inserted into the first end 106 of the coaxial cable connector 100. The coaxial cable 800 is fed into the coaxial cable connector 100 such that the circular barb 118 of the tubular post 104 inserts between the dielectric material 804 and the outer conductor 806 of the coaxial cable 800, making contact with the outer conductor 806. A compression tool (not shown) advances the shell 106 toward the coupler 112. As the shell 106 is advanced over the external annular surface 134 of the body 114 toward the coupler 112, the reduced diameter of the central passageway 156 forces the gripping member 160 against the cable jacket 808. In this manner, the coaxial cable 800 is retained in the coaxial cable connector 100. Additionally, the circular barb 118 positioned between the dielectric material 804 and the outer conductor 806 acts to maximize the retention strength of the cable jacket 802 within coaxial cable connector 100. As the shell 106 moves toward the second end of the coaxial cable connector 100, the shell 106 causes the gripper member 160 to compress the cable jacket 808 such that the cable jacket 808 is compressed between the gripper member 160 and the circular barb 118 increasing the pull-out force required to dislodge cable 800 from coaxial cable connector 100. Since the outer conductor 806 is in contact with the tubular post 104 an electrically conductive path is established from the outer conductor 206 through the tubular post 104 to the body 114 to the integral shield element 102 and, thereby, to the coupler 112.

Further, the integral shield element 102 being part of the body 114 within the connector 100 ensures the electrically-conductive path remains established independent of the tightness of the coaxial cable connector 100 on the appliance equipment connection port. In other words, the integral shield element 102 being part of the body 114 is inherently in the electrically conductive path established between the body 114 and coupler 112 even when the coaxial cable connector is loosened and/or disconnected from the appliance equipment connection port. Additionally, the integral shield element 102 has resilient and flexible cantilevered annular beams 138 disposed against the rearward facing annular surface 128 of the coupler 112. In this manner, the cantilevered annular beams 138 maintain contact with the coupler independent of tightness of the coaxial cable connector 100 on the appliance equipment connection port without restricting the movement, including the rotation of the coupler 112.

Figure 8:
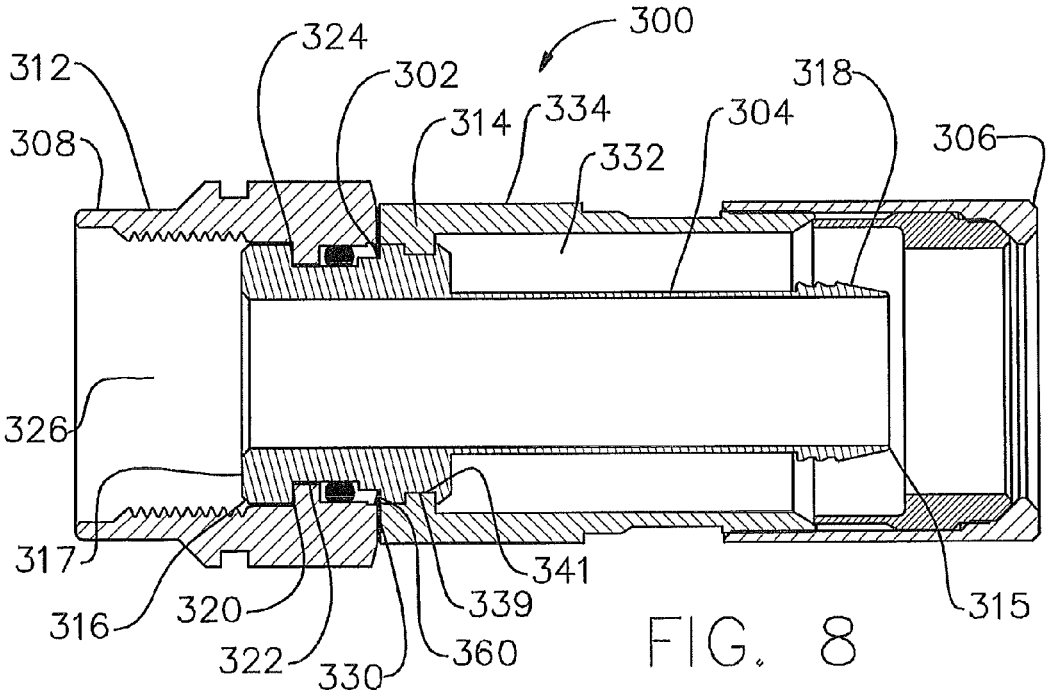
FIG. 8 is a cross sectional view of an alternate embodiment of a type of a coaxial connector comprising a coupler with an integral shield element as disclosed herein.
Figure 8A:
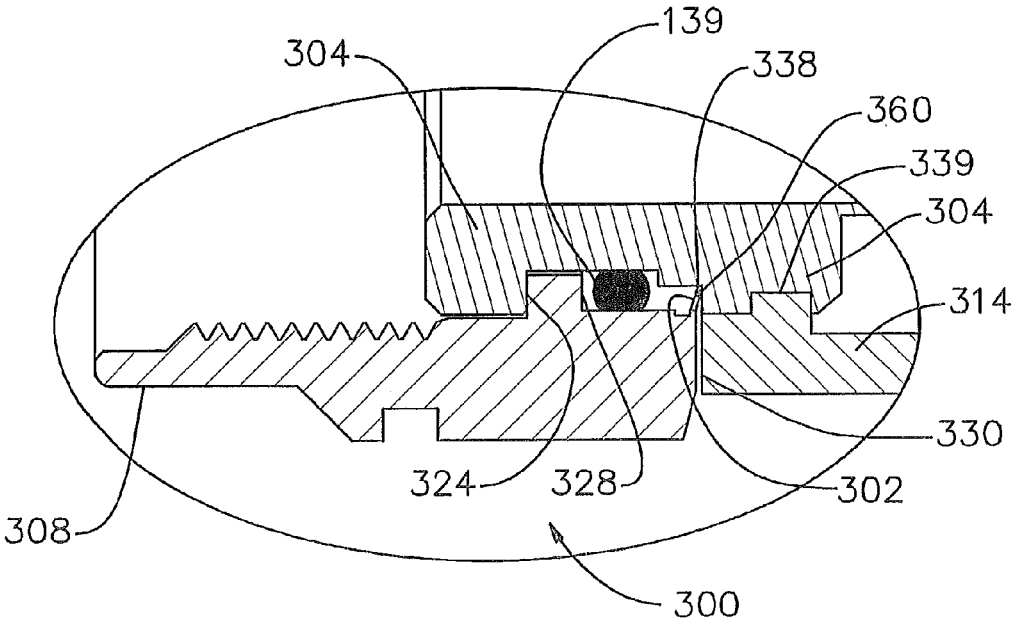
FIG. 8A is a detail section of a portion of FIG. 8.

FIGS. 8 and 8A, illustrate an exemplary embodiment of coaxial cable connector 300 having coupler 312 comprising an integral shield element 302 to provide a stable ground path and protect against the ingress of RF signals. The tubular post 304 has a first end 315 which is adapted to extend into a coaxial cable and a second end 317. An enlarged shoulder 316 at the second end 317 extends inside the coupler 312. At the first end 315, the tubular post 304 has a circular barb 318 extending radially outwardly from the tubular post 304. The enlarged shoulder 316 comprises a first rearward facing annular shoulder 320, a stepped diameter leading to a second rearward facing annular shoulder 322 and a forward facing annular surface 360. Forward facing annular surface 360 may be orthogonal or oblique to the axis of body 314. The coupler 312 comprises a forward facing annular surface 324, a through-bore 326, a rearward facing annular surface 328, and an integral shield element 302. The body 314 at least partially comprises a face 330, a through bore 332, a reduced portion 339, and an external annular surface 334. In this embodiment the body 314 may be of a non-conductive material such as Acetal or the like. Body 314 may engage post 304 by means of a snap fit of reduced portion 339 of body 314 into annular groove 341 in post 304. The integral shield element 302 of coupler 312 establishes an electrically conductive path between the coupler 312 and the forward facing annular surface 360 of post 304. Further, the integral shield element 302 remains in contact with forward facing annular surface 360 of post 304 independent of the tightness of the coaxial cable connector 300 on the appliance equipment connection port. In other words, the integral shield element 302 remains secured and the electrically conductive path remains established between the coupler 312 and the post 304 even when the coaxial cable connector is loosened and/or disconnected from the appliance equipment connection port. Additionally, the integral shield element 302 has resilient and flexible cantilevered annular beams 338 disposed against the forward facing annular surface 360 of the post 304. In this manner, the cantilevered annular beams 338 maintain contact with the post independent of tightness of the coaxial cable connector 300 on the appliance equipment connection port without restricting the movement, including the rotation of the coupler 312. The coaxial cable connector 300 may also include a sealing ring 139 seated within the coupler 312 to form a seal between the coupler 312 and the post 304.

Figure 9:
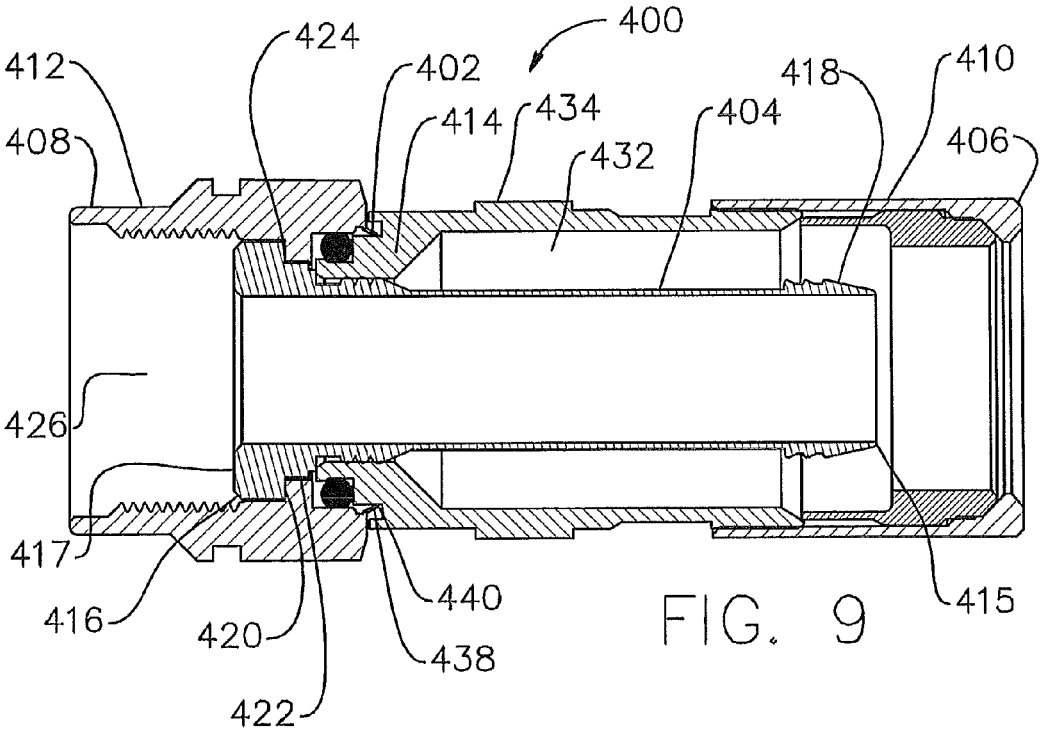
FIG. 9 is a cross sectional view of an alternate embodiment of a type of a coaxial connector comprising a coupler with an integral shield element as disclosed herein.
Figure 9A:
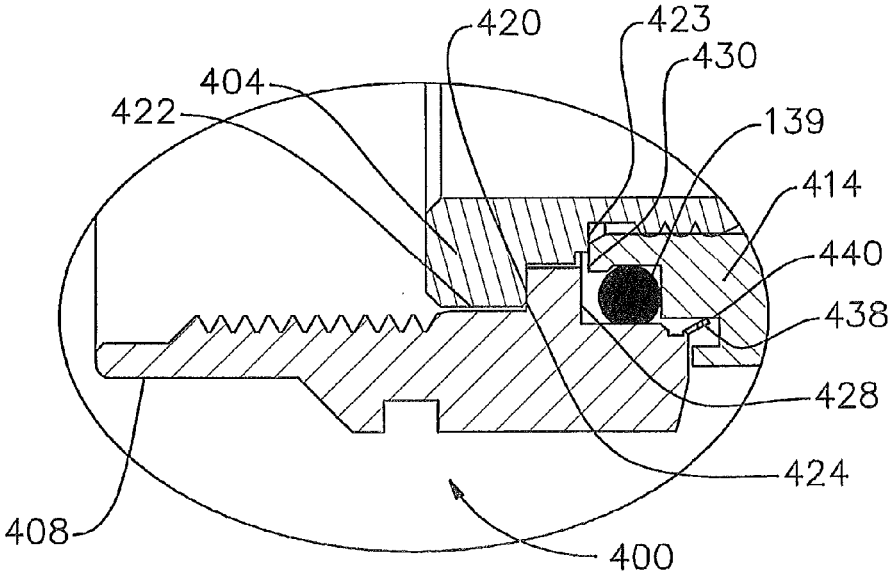
FIG. 9A is a detail section of a portion of FIG. 9.

FIGS. 9 and 9A, illustrate an exemplary embodiment of coaxial cable connector 400 having coupler 412 comprising an integral shield element 402 to provide a stable ground path and protect against the ingress of RF signals. The tubular post 404 has a first end 415 which is adapted to extend into a coaxial cable and a second end 417. An enlarged shoulder 416 at the second end 417 extends inside the coupler 412. At the first end 415, the tubular post 404 has a circular barb 418 extending radially outwardly from the tubular post 404. The enlarged shoulder 416 comprises a first rearward facing annular shoulder 420, and a stepped diameter leading to a second rearward facing annular shoulder 422. The coupler 412 comprises a forward facing annular surface 424, a through-bore 426, a rearward facing annular surface 428, and an integral shield element 402. The body 414 at least partially comprises a face 430, a through bore 432 and an external annular surface 434 and an outer diameter 440. Outer diameter 440 may be orthogonal or oblique to the axis of body 414. Body 414 engages post 404 by means of a press fit between corresponding conductive surfaces. The integral shield element 402 of coupler 412 establishes an electrically conductive path between the coupler 412 and the outer diameter 440 of body 414. Further, the integral shield element 402 remains in contact with body 414 independent of the tightness of the coaxial cable connector 400 on the appliance equipment connection port. In other words, the integral shield element 402 remains secured and the electrically conductive path remains established between the body 404 and the coupler 412 even when the coaxial cable connector is loosened and/or disconnected from the appliance equipment connection port. Additionally, the integral shield element 402 has resilient and flexible cantilevered annular beams 438 disposed against the outer diameter 440 of body 414. In this manner, the cantilevered annular beams 438 maintain contact with the body independent of tightness of the coaxial cable connector 400 on the appliance equipment connection port without restricting the movement, including the rotation of the coupler 412. The coaxial cable connector 400 may also include a sealing ring 139 seated within the coupler 412 to form a seal between the coupler 412 and the body 414.

Figure 10:
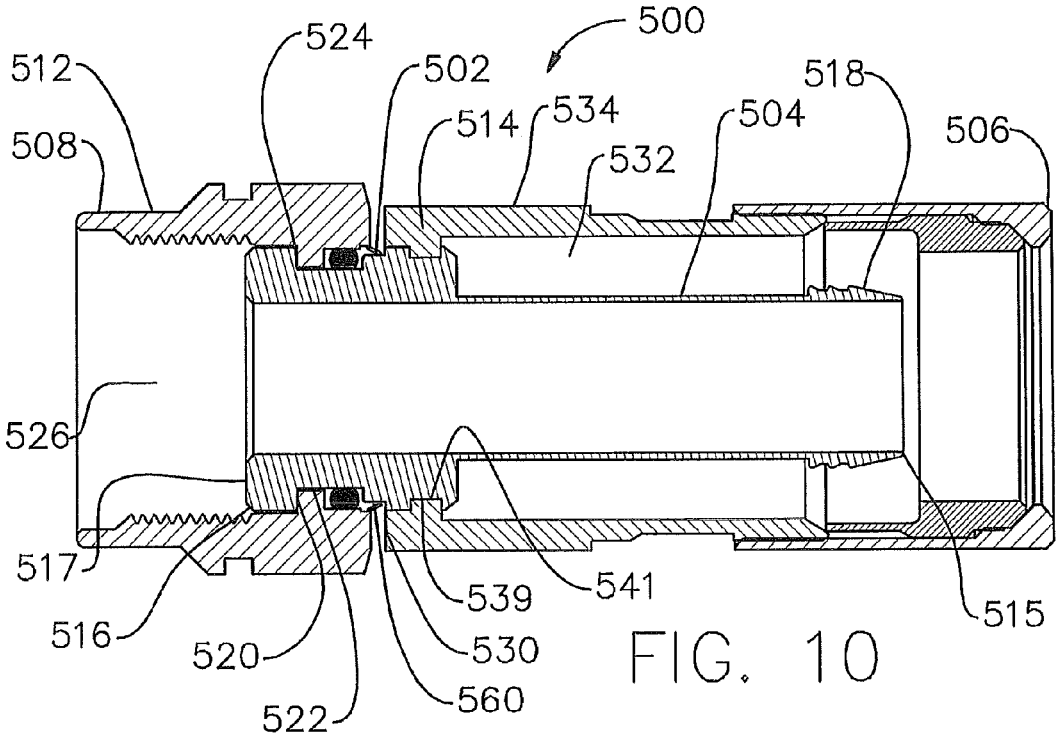
FIG. 10 is a cross sectional view of an alternate embodiment of a type of a coaxial connector comprising a coupler with an integral shield element as disclosed herein.
Figure 10A:
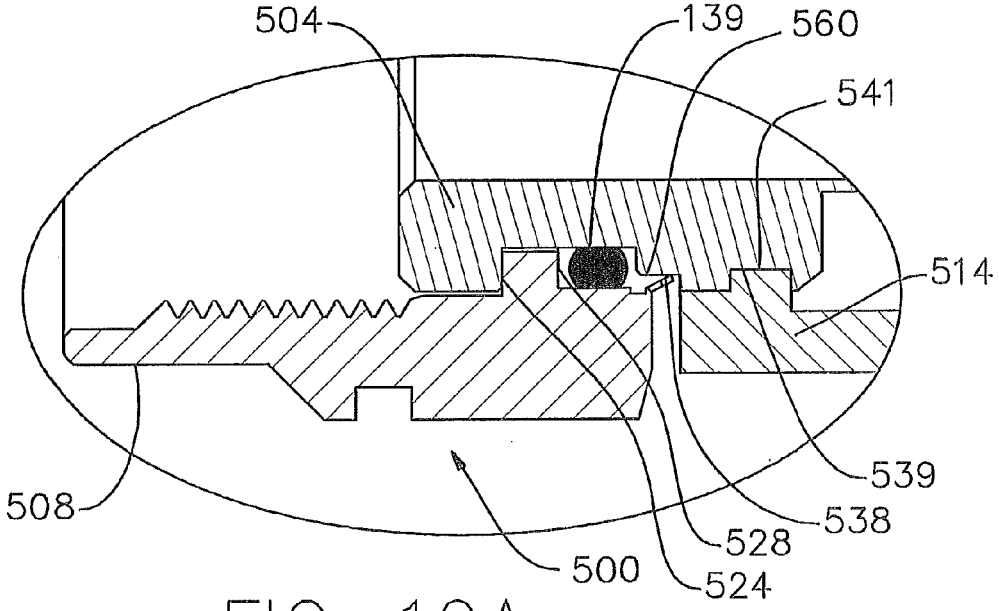
FIG. 10A is a detail section of a portion of FIG. 10.

FIGS. 10 and 10A, illustrate an exemplary embodiment of coaxial cable connector 500 having coupler 512 comprising an integral shield element 502 to provide a stable ground path and protect against the ingress of RF signals. The tubular post 504 has a first end 515 which is adapted to extend into a coaxial cable and a second end 517. An enlarged shoulder 516 at the second end 517 extends inside the coupler 512. At the first end 515, the tubular post 504 has a circular barb 518 extending radially outwardly from the tubular post 504. The enlarged shoulder 516 comprises, at least partially, a first rearward facing annular shoulder 520, a stepped diameter leading to a second rearward facing annular shoulder 522 and an outer diameter 560. Outer diameter 560 may be orthogonal or oblique to the axis of body 514. The coupler 512 comprises a forward facing annular surface 524, a through-bore 526, a rearward facing annular surface 528, and an integral shield element 502. The body 514 at least partially comprises a face 530, a through bore 532, a reduced portion 539, and an external annular surface 534. In this embodiment the body 514 may be of a non-conductive material such as Acetal or the like. Body 514 may engage post 504 by means of a snap fit of reduced portion 539 of body 514 into annular groove 541 in post 504. The integral shield element 502 of coupler 512 establishes an electrically conductive path between the coupler 512 and the outer diameter 560 of post 504. Further, the integral shield element 502 remains in contact with outer diameter 560 of post 504 independent of the tightness of the coaxial cable connector 500 on the appliance equipment connection port. In other words, the integral shield element 502 remains secured and the electrically conductive path remains established between the post 504 and the coupler 512 even when the coaxial cable connector is loosened and/or disconnected from the appliance equipment connection port. Additionally, the integral shield element 502 has resilient and flexible cantilevered annular beams 538 disposed against the outer diameter 560 of post 504. In this manner, the cantilevered annular beams 538 maintain contact with the post independent of tightness of the coaxial cable connector 500 on the appliance equipment connection port without restricting the movement, including the rotation of the coupler 512. The coaxial cable connector 500 may also include a sealing ring 139 seated within the coupler 512 to form a seal between the coupler 512 and the post 504.

Figure 11:
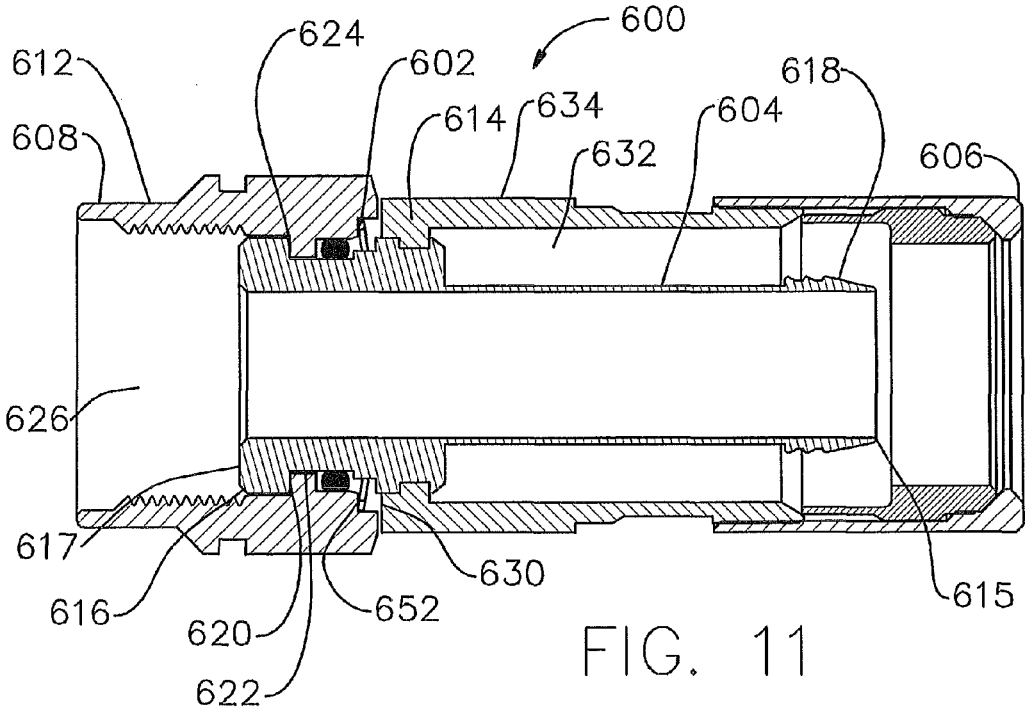
FIG. 11 is a cross sectional view of an alternate embodiment of a type of a coaxial connector comprising a post with an integral shield element as disclosed herein.
Figure 11A:
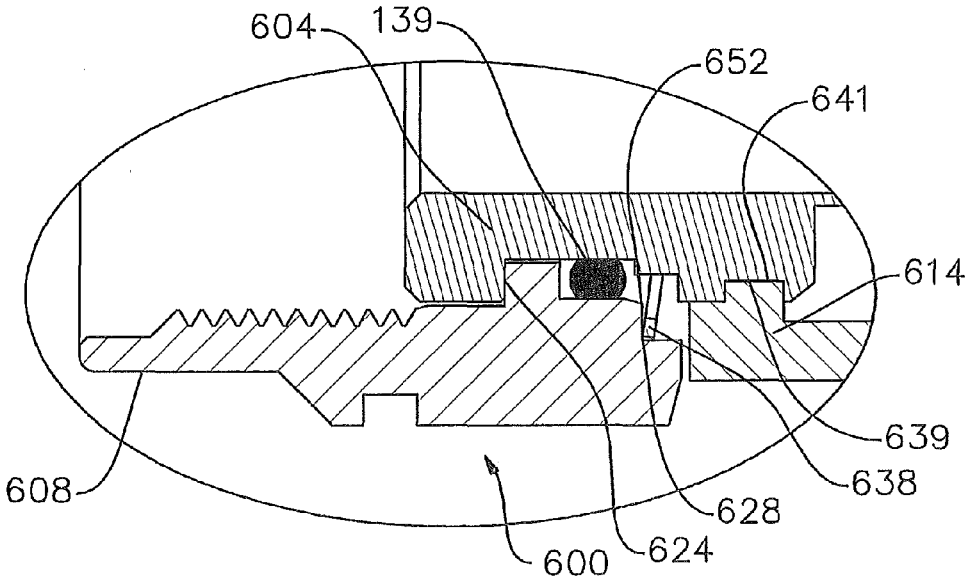
FIG. 11A is a detail section of a portion of FIG. 11.

FIGS. 11 and 11A, illustrate an exemplary embodiment of coaxial cable connector 600 having coupler 612 comprising a forward facing annular surface 624, a through-bore 626, a rearward facing annular surface 628, and a rearward facing annular surface 652. Rearward facing annular surface 652 may be orthogonal or oblique to the axis of the coupler 612. The tubular post 604 has a first end 615 which is adapted to extend into a coaxial cable and a second end 617. An enlarged shoulder 616 at the second end 617 extends inside the coupler 612. At the first end 615, the tubular post 604 has a circular barb 618 extending radially outwardly from the tubular post 604. The enlarged shoulder 616 comprises a first rearward facing annular shoulder 620, a stepped diameter leading to a second rearward facing annular shoulder 622 and an integral shield element 602 to provide a stable ground path and protect against the ingress of RF signals. The body 614 at least partially comprises a face 630, a through bore 632, a reduced portion 639, and an external annular surface 634. In this embodiment the body 614 may be of a non-conductive material such as Acetal or the like. Body 614 may engage post 604 by means of a snap fit of reduced portion 639 of body 614 into annular groove 641 in post 604. The integral shield element 602 of post 604 establishes an electrically conductive path between the post 604 and the rearward facing annular surface 652 of the coupler 612. Further, the integral shield element 602 remains in contact with rearward facing annular surface 652 of the coupler 612 independent of the tightness of the coaxial cable connector 600 on the appliance equipment connection port. In other words, the integral shield element 602 remains secured and the electrically conductive path remains established between the post 604 and the coupler 612 even when the coaxial cable connector is loosened and/or disconnected from the appliance equipment connection port. Additionally, the integral shield element 602 has resilient and flexible cantilevered annular beams 638 disposed against the rearward facing annular surface 652 of the coupler 612. In this manner, the cantilevered annular beams 638 maintain contact with the coupler independent of tightness of the coaxial cable connector 600 on the appliance equipment connection port without restricting the movement, including the rotation of the coupler 612. The coaxial cable connector 600 may also include a sealing ring 139 seated within the coupler 612 to form a seal between the coupler 612 and the post 604.

Figure 12:
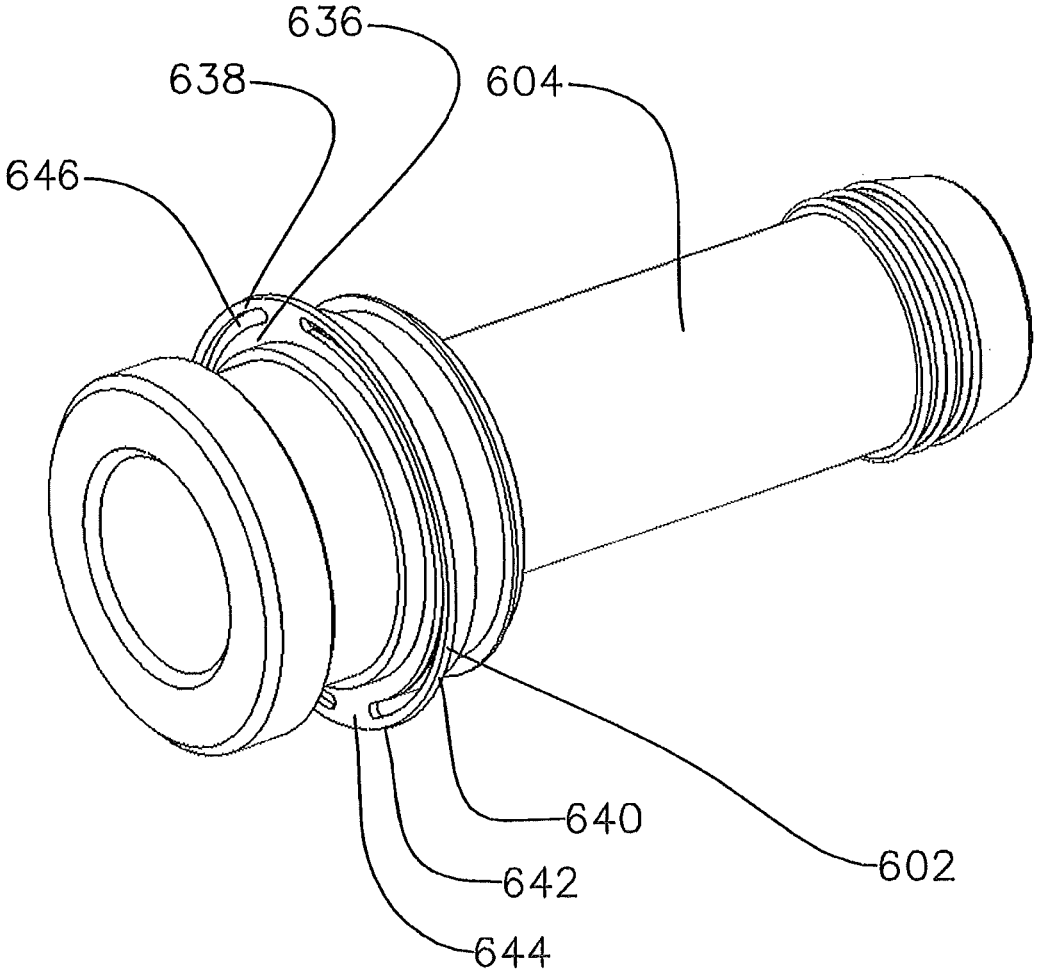
FIG. 12 is a isometric schematic view of a post as related to FIG. 11 and FIG. 11A.

FIG. 12 is an isometric schematic view of a post 604 as related to FIG. 11 and FIG. 11A illustrating slots 646 and cantilevered annular beams 638 and other features as outlined herein. The integral shield element 602 may be circular with the inner segment 636 and at least one pre-formed cantilevered annular beam 638. The least one pre-formed cantilevered annular beam 638 is flexible, arcuately shaped and extends at approximately a 19° angle from the plane of the inner segment 636. The pre-formed cantilevered annular beam 638 has an outer surface 640 with an edge 642, as shown in FIG. 12. Joining segment 644 joins the pre-formed cantilevered annular beam 638 to the inner segment 636 forming a slot 646 therebetween. Post 604 and therefore integral shield element 602 may be made from a metallic material, including as a non-limiting examples, brass or phosphor bronze, additionally or alternatively, the integral shield element 602 may be un-plated or plated with a conductive material, as non-limiting examples tin, tin-nickel or the like.

Figure 13:
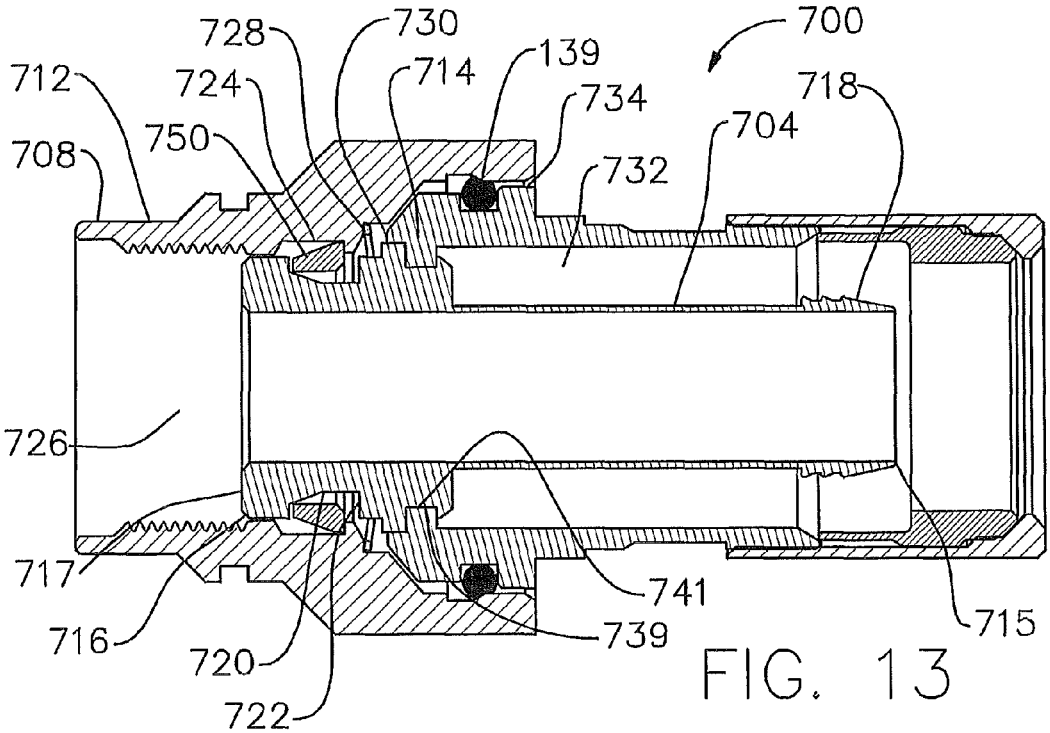
FIG. 13 is a cross sectional view of an alternate embodiment of a type of coaxial connector comprising a post with an integral shield element as disclosed herein.
Figure 13A:
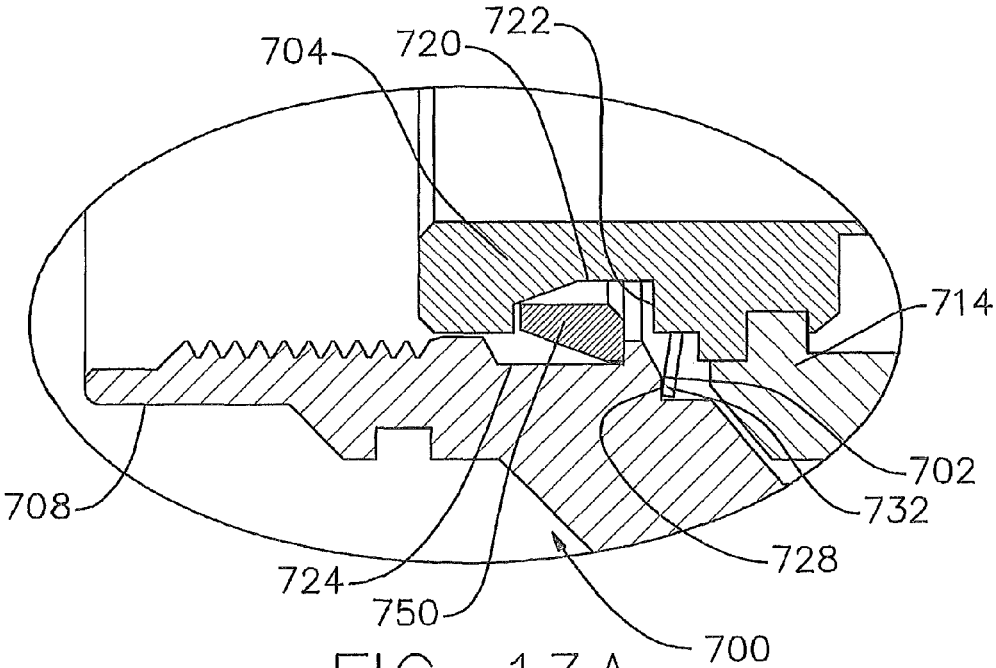
FIG. 13A is a detail section of a portion of FIG. 13

FIGS. 13 and 13A, illustrate an exemplary embodiment of coaxial cable connector 700 having coupler 712 at least partially comprising an annular recess 724, a through-bore 726, and a rearward facing annular surface 728. Communication Ring 750 is disposed between coupler 712 and post 704 allowing rotational coupling of the components while simultaneously providing mechanical and electrical communication between the components. Rearward facing annular surface 728 may be orthogonal or oblique to the axis of the coupler 712. The tubular post 704 has a first end 715 which is adapted to extend into a coaxial cable and a second end 717. An enlarged shoulder 716 at the second end 717 extends inside the coupler 712. At the first end 715, the tubular post 704 has a circular barb 718 extending radially outwardly from the tubular post 704. The enlarged shoulder 716 comprises a groove 720, leading to a forward facing annular shoulder 722 and an additional (additional to ring 750) and integral shield element 702 to provide another stable ground path and protect against the ingress of RF signals. The body 714 at least partially comprises a face 730, a through bore 732, a reduced portion 739, and an external annular surface 734. In this embodiment the body 714 may be of a non-conductive material such as Acetal or the like. Body 714 may engage post 704 by means of a snap fit of reduced portion 739 of body 714 into annular groove 741 in post 704. The integral shield element 702 of post 704 establishes an electrically conductive path between the post 704 and the rearward facing annular surface 728 of the coupler 712. Further, the integral shield element 702 remains in contact with rearward facing annular surface 728 of the coupler 712 independent of the tightness of the coaxial cable connector 700 on the appliance equipment connection port. In other words, the integral shield element 702 remains secured and the electrically conductive path remains established between the post 704 and the coupler 712 even when the coaxial cable connector is loosened and/or disconnected from the appliance equipment connection port. Additionally, the integral shield element 702 has resilient and flexible cantilevered annular beams 732 disposed against the rearward facing annular surface 728 of the coupler 712. In this manner, the cantilevered annular beams 732 maintain contact with the coupler independent of tightness of the coaxial cable connector 700 on the appliance equipment connection port without restricting the movement, including the rotation of the coupler 712. The coaxial cable connector 700 may also include a sealing ring 139 seated within the coupler 712 to form a seal between the coupler 712 and the body 714.

It will be apparent to those skilled in the art that various modifications and variations can be made to the embodiments discussed above. Additionally, the embodiments of the shield 102 may be used with other types of coaxial cable connector shield including without limitation, compression, compression-less and post-less coaxial cable connectors. Thus, it is intended that this description cover the modifications and variations of the embodiments and their applications.

What is claimed is:

1. A coaxial cable connector for coupling a coaxial cable to an equipment port, the coaxial cable including a center conductor surrounded by a dielectric material, the dielectric material being surrounded by an outer conductor, the coaxial cable connector comprising:

a tubular post having a first end adapted to be inserted into a prepared end of the coaxial cable between the dielectric material and the outer conductor, and having a second end opposite the first end thereof;

a coupler having a first end rotatably secured over the second end of the tubular post, and having an opposing second end, the coupler including a central bore extending therethrough, a portion of the central bore proximate the second end of the coupler being adapted for engaging the equipment port; and a body secured to the tubular post and extending about the first end of the tubular post for receiving the outer conductor of the coaxial cable, wherein a portion of at least one of the tubular post, the coupler and the body is integral to the portion of the at least one of the tubular post, the coupler and the body and provides a spring-like force on a surface of at least one of the other of the tubular post, the coupler and the body to establish an electrically conductive path therebetween.

2. The coaxial cable connector of claim 1, wherein the portion of the at least one of the tubular post, the coupler and the body is a unitized portion of the at least one of the tubular post, the coupler and the body.

3. The coaxial cable connector of claim 1, wherein the portion of the at least one of the tubular post, the coupler and the body comprises at least one pre-formed cantilevered beam.

4. The coaxial cable connector of claim 3, wherein the at least one pre-formed cantilevered annular beam is arcuately shaped.

5. The coaxial cable connector of claim 3, wherein the at least one pre-formed cantilevered annular beam comprises an outer surface with an edge, and wherein the edge has a knife-like sharpness and provides a wiping action of surface oxides on the at least one of the other of the tubular post, the coupler and the body.

6. The coaxial cable connector of claim 3, wherein the portion comprises a circular inner segment.

7. The coaxial cable connector of claim 6, wherein at least one of the circular inner segment and the at least one pre-formed cantilevered annular beam are metallic.

8. The coaxial cable connector of claim 6, wherein at least one of the circular inner segment and the at least one pre-formed cantilevered annular beam are formed of phosphor bronze.

9. The coaxial cable connector of claim 1, wherein the portion comprises a conductive material plating.

10. The coaxial cable connector of claim 9, wherein the conductive material plating is one of tin and tin-nickel.

11. The coaxial cable connector of claim 3, wherein the at least one pre-formed cantilevered annular beam comprises a plurality of pre-formed cantilevered annular beams.

12. The coaxial cable connector for claim 1 wherein the portion of the at least one of the tubular post, the coupler and the body provides the electrically-conductive path independent of the tightness of the coaxial cable connector.

13. The coaxial cable connector of claim 5, wherein the at least one pre-formed cantilevered annular beam is resilient relative to the longitudinal axis of the connector and maintains an arcuately increased surface of sliding electrical contact to the at least one of the other of the tubular post, the coupler and the body.

14. The coaxial cable connector of claim 1, wherein the portion of the at least one of the tubular post, the coupler and the body provides for unrestricted rotation of the coupler.

15. The coaxial cable connector of claim 1, wherein the portion of the at least one of the tubular post, the coupler and the body maintains the electrically conductive path between the coaxial cable conductor and an equipment connection port of an appliance when the coupler is loosened from while in contact with the equipment connection port.

16. A coaxial cable connector for coupling a coaxial cable to an equipment port, the coaxial cable including a center conductor surrounded by a dielectric material, the dielectric material being surrounded by an outer conductor, the coaxial cable connector comprising:

a tubular post having a first end adapted to be inserted into the prepared end of the coaxial cable between the dielectric material and the outer conductor, and having a second end opposite the first end thereof;

a coupler having a first end rotatably secured over the second end of the tubular post, and having an opposing second end, the coupler including a central bore extending therethrough, a portion of the central bore proximate the second end of the coupler being adapted for engaging the equipment port;

a body secured to the tubular post and extending about the first end of the tubular post for receiving the outer conductor of the coaxial cable; and a resilient, electrically-conductive integral shield element integral to the body, the integral shield element having an inner segment and at least one pre-formed cantilevered annular beam attached to the inner segment, wherein the inner segment is disposed proximate to and in contact with the body, and the at least one pre-formed cantilevered annular beam exerts a spring-like force on the coupler, and wherein the integral shield element provides an electrically-conductive path between the body and the coupler.

17. The coaxial cable connector of claim 16, wherein the integral shield element remains captured and secured and provides the electrically-conductive path independent of the tightness of the coaxial cable connector.

18. The coaxial cable connector of claim 16, wherein the integral shield element is generally circular and the at least one pre-formed cantilevered annular beam is arcuately shaped.

19. The coaxial cable connector of claim 16, wherein the second end of the tubular post has an enlarged shoulder comprising a first rearward facing annular shoulder and a second rearward facing annular shoulder.

20. The coaxial cable connector of claim 16, wherein the coupler comprises a rearward facing annular surface, and wherein the at least one pre-formed cantilevered annular beam exerts a spring-like force on the coupler at the rearward facing annular surface.

21. The coaxial cable connector of claim 18, wherein the integral shield element is resilient relative to the longitudinal axis of the connector and maintains an arcuately increased surface of sliding electrical contact between the integral shield element and the rearward facing annular surface of the coupler.

22. The coaxial cable connector of claim 16, wherein the at least one pre-formed cantilevered annular beam comprises an outer surface with an edge, and wherein the edge has a knife-like sharpness and provides a wiping action of surface oxides on a surface of the coupler.

23. The coaxial cable connector of claim 16, wherein the integral shield element provides for unrestricted rotation of the coupler.

24. The coaxial cable connector of claim 16, wherein the integral shield element maintains the electrically conductive path between the coaxial cable conductor and an equipment connection port of an appliance when the coupler is loosened from while in contact with the equipment connection port.

25. The coaxial cable connector of claim 16 wherein the integral shield element is a unitized portion of the body.

* * * * *